US005734119A

United States Patent [19]

France et al.

[11] Patent Number: 5,734,119

[45] Date of Patent: Mar. 31, 1998

[54] METHOD FOR STREAMING TRANSMISSION OF COMPRESSED MUSIC

[75] Inventors: Gordon Scott France, Palo Alto; Steven S. Lee, Sunnyvale, both of Calif.

[73] Assignee: Invision Interactive, Inc., Palo Alto, Calif.

[21] Appl. No.: 769,400

[22] Filed: Dec. 19, 1996

[51] Int. Cl.[6] ..... G10H 1/06; G10H 7/00

[52] U.S. Cl. ..... 84/622; 84/645

[58] Field of Search ..... 84/601–607, 622–625, 84/645

[56] References Cited

U.S. PATENT DOCUMENTS

| | | | |
|---|---|---|---|
| 4,953,039 | 8/1990 | Ploch | 360/32 |
| 5,119,711 | 6/1992 | Bell et al. | 84/622 |
| 5,315,057 | 5/1994 | Land et al. | 84/601 |
| 5,390,138 | 2/1995 | Milne et al. | 381/119 |
| 5,484,291 | 1/1996 | Nakai et al. | 434/307 A |

*Primary Examiner*—Stanley J. Witkowski

*Attorney, Agent, or Firm*—Limbach & Limbach L.L.P.

[57] ABSTRACT

An Internet high fidelity audio transmission and compression protocol including a system for representing synthesized music in a relatively small file as compared to digital recording. The protocol includes a method for streaming the transmission of a music data file from a Server-Composer computer such that the music can begin being played back as soon as the file begins to arrive at a Client-Player computer. The system includes a graduated resolution improvement feature which allows the music to be recreated exactly as originally composed as the necessary wavetable data is downloading in the background and the music continues to play in the foreground.

7 Claims, 16 Drawing Sheets

METHOD FOR STREAMING TRANSMISSION OF COMPRESSED MUSIC

RELATED APPLICATIONS

This application is related to U.S. patent application No. 08/561,889 filed on Nov. 22, 1995, and now U.S. Pat. No. 5,596,159 and U.S. patent application No. 08/672,096 filed Jun. 27, 1996, both entitled "SOFTWARE SOUND SYNTHESIS SYSTEM" by Steven S. O'Connell, assigned to the assignee of the present invention, and incorporated herein by reference.

TECHNICAL FIELD

This invention relates to the transmission and immediate playback of synthesized music over a limited bandwidth medium such as the Internet. More particularly, it relates to a method of creating, on a server, a data file that accurately represents synthesized music in a compressed format and transferring this file to an Internet client using a streaming protocol.

BACKGROUND ART

Due to the enormous amount of binary data required to record music in a digital format, numerous methods of compressing digital files representative of analog sound waves have been developed. These methods have made it possible to reduce the vast amount of information needed to later playback the music. However, these methods necessitate significant degradation in the quality of the music stored. As the information is compressed, data is lost and upon playback, it becomes difficult or impossible to re-create the original sound precisely.

The Musical Instrument Digital Interface (MIDI) standard was developed to permit the transfer of music using command symbols to represent sounds and their duration. MIDI is essentially a communications protocol used with electronic musical instruments. The standard structure and composition of the composition database, which is based upon the standard MIDI file format and specification, is now discussed. Complete details of the MIDI specification and file format used in forming the composition database of the preferred embodiment may be found in the MIDI 1.0 DETAILED SPECIFICATION (1990) which is available from The MIDI Manufacturers Association, Los Angeles, Calif., and the entire disclosure which is hereby incorporated by reference.

Consider first the structure and use of a standard MIDI sound file. The purpose of MIDI sound files is to provide a way of exchanging "time-stamped" MIDI data between different programs running on the same or different computers. MIDI files contain one or more sequences of MIDI and non-MIDI "events", where each event is a musical action to be taken by one or more instruments and each event is specified by a particular MIDI or non-MIDI message. Time information (e.g. for utilization) is also included for each event. Most of the commonly used song, sequence, and track structures, along with tempo and time signature information, are all supported by the MIDI file format. The MIDI file format also supports multiple tracks and multiple sequences so that more complex files can be easily moved from one program to another.

Within any computer file system, a MIDI file is comprised of a series of words called "chunks". FIG. 19(*a*) and 19(*b*) represent the standard format of the MIDI file chunks with each chunk (FIG. 19(*a*) and 19(*b*)) having a 4-character ASCII type and a 32-bit length. Specifically the two types of chunks are header chunks (type Mthd 314, FIG. 19(*a*)) and track chunks (type Mtrk 324, FIG. 19(*b*)). Header chunks provide information relating to the entire MIDI file, while track chunks contain a sequential stream of MIDI performance data for up to 16 MIDI channels (i.e. 16 instrument parts). A MIDI file always starts with a header chunk, and is followed by one or more track chunks.

Referring now to FIG. 19(*a*), the format of a standard header chunk is now discussed in more detail. The header chunk provides basic information about the performance data stored in the file. The first field of the header contains a 4-character ASCII chunk type 314 which specifies a header type chunk and the second field contains a 32-bit length 316 which specifies the number of bytes following the length field. The third field, format 318, specifies the overall organization of the file as either a single multi-channel track ("format 0"), one or more simultaneous tracks ("format 1"), or one or more sequentially independent tracks ("format 2"). Each track contains the performance data for one instrument part.

Continuing with FIG. 19(*a*), the fourth field, ntracks 320, specifies the number of track chunks in the file. This field will always be set to 1 for a format 0 file. Finally, the fifth field, division 322, is a 16-bit field which specifies the meaning of the event delta-time; the time to elapse before the next event. The division field has two possible formats, one for metrical time (bit 15=0) and one for time-code-based time (bit 15=1). For example, if bit 15=0 then bits 14 through 0 represent the number of delta-time "ticks" that make up a quarter note. However, if bit 15=1 (for example) then bits 14 through 0 specify the delta-time in sub-divisions of a second in accordance with an industry standard time code format.

Referring now to FIG. 19(*b*), the format of a standard track chunk 310 is now discussed. Track chunk 310 stores the actual music performance data, which is specified by a stream of MIDI and non-MIDI events. As shown in FIG. (*b*), the format used for track chunk 310 is an ASCII chunk type 324 which specifies the track chunk, a 32-bit length 326 which specifies the number of MIDI and non-MIDI events of bytes 328–330n which follow the length field 326, with each event 334 proceeded by a delta-time value 332. Recall that the delta-time 332 is the amount of time before an associated event 334 occurs, and it is expressed in one of the two formats as discussed in the previous paragraph. Events are any MIDI or non-MIDI message, with the first event in each track chunk specifying the message status.

An example of a MIDI event can be turning on a musical note. This MIDI event is specified by a corresponding MIDI message "note-on". The delta-time for the current message is retrieved, and the sequencer waits until the time specified by the delta-time has elapsed before retrieving the event which turns on the note. It then retrieves the next delta-time for the next event and the process continues.

Normally, one or more of the following five message types is supported by a MIDI system: channel voice, channel mode, system common, system real-time, and system exclusive. All five types of messages are not necessarily supported by every MIDI system. Channel voice messages are used to control the music performance of an instrumental part, while channel mode messages are used to define the instrument's response to the channel voice messages. System common messages are used to control multiple receivers and they are intended for all receivers in the system regardless of channel. System real-time messages are used for synchronization and they are directed to all clock-based receivers in the system. System exclusive messages are used to control functions which are specific to a particular type of receiver, and they are recognized and processed only by the type of receiver for which they were intended.

For example, the "note-on" message of the previous example is a channel voice message which turns on a particular musical note. The channel mode message "reset-all-controllers" resets all the instruments of the system to some initial state. The system real time message "start" commands synchronizes all receivers to start playing. The system common message "song-select" selects the next sequence to be played.

Each MIDI message normally consists of one 8-bit status byte (MSB=1) followed by one or two 8-bit data bytes (MSB=0) data bytes which carry the content of the MIDI message. Note however that system exclusive and system real-time messages may have more than two data bytes. The 8-bit status byte identifies the message type, that is, the purpose of the data bytes that follow. In processing channel voice and channel mode messages, once a status byte is received and processed, the receiver remains in that status until a different status byte from another message is received. This allows the status bytes of a sequence of channel type messages to be omitted so that only the data bytes need to be sent and processed. This procedure is frequently called "running status" and is useful when sending long strings of note-on and note-off messages, which are used to turn on or turn off individual musical notes.

For each status byte the correct number of data bytes must be sent, and the receiver normally waits until all data bytes for a given message have been received before processing the message. Additionally, the receiver will generally ignore any data bytes which have not been preceded by a valid status byte.

FIG. 19(*b*) shows the general format for a system exclusive message 312. A system exclusive message 312 is used to send commands or data that is specific to a particular type of receiver, and such messages are ignored by all other receivers. For example, a system exclusive message may be used to set the feedback level for an operator in an FM digital synthesizer with no corresponding function in an analog synthesizer.

Referring again to FIG. 19(*b*), each system exclusive message 312 begins with a hexadecimal F0 code 336 followed by a 32-bit length 338. The encoded length does not include the F0 code, but specifies the number of data bytes 340 in the message including the termination code F7 342. Each system exclusive message must be terminated by the F7 code so that the receiver of the message knows that it has read the entire message.

FIG. 19(*b*) also shows the format for a meta message 313. Meta messages are placed in the MIDI file to specify non-MIDI information which may be useful. (For example, the meta message "end-of-track" tells the sequencer that the end of the currently playing sound file has been reached.) Meta message 313 begins with an FF code 344, followed by an event type 346 and length 348. If Meta message 313 does not contain any data, length 348 is zero, otherwise, length 348 is set to the number of data bytes 350n. Receivers will ignore any meta messages which they do not recognize. A further description of the MIDI standard format can be gleaned from U.S. Pat. No. 5,315,057 from which the above description was taken.

Thus, MIDI is a powerful method of representing and transmitting music data. The MIDI system allows music to be represented with only a few symbols as compared to converting an analog signal to many digital symbols. The MIDI standard supports up to sixteen different channels that can each simultaneously provide a command stream. Typically, the command stream for each channel represents the notes from one instrument. However, MIDI commands can program a channel to be a particular instrument or combination of instruments. Once programmed, the note commands for the channel will be played or recorded as the instrument or instruments for which the channel has been programmed. During a particular piece of music, a channel can be dynamically reprogrammed to be different instruments.

While the MIDI standard does allow representation and thus, recording of many standard instruments, there is a trade-off. The MIDI standard only defines a limited library of standard voices of traditional instruments. Using the MIDI system alone to represent music restricts the number and types of voices that can be transmitted over the Internet as well as customized synthesis at the receiving end.

The development of the "SOFTWARE SOUND SYNTHESIS SYSTEM" as described in copending U.S. patent application Ser. Nos. 08/561,889 and 08/672,096 allows the synthesis of musical instruments using several different synthesis techniques and a set of special effects processing. The software system (hereinafter sometimes referred to as the Cybersound Software Sound Synthesis System or "SSSS") also provides a means of digitally representing the particular synthesis techniques used to create the sounds as well as the effects applied to the sound.

There are a number of known synthesis techniques typically used for musical sound synthesis such as wavetable (i.e. pulse code modulation (PCM) data of actual sounds), frequency modulation (FM), analog and physical modeling.

Not all the techniques above are appropriate for all the musical instruments that a user may be wish to synthesize. For example, physical modeling is an excellent way to reproduce the sound of a clarinet. A piano, however, may be more effectively reproduced using wavetables. In addition, the type of sound generated by one technique may be more desirable than others. For instance, the characteristic sound obtained from an analog synthesizer is highly recognizable and, in some cases, desirable.

The synthesis techniques above are further described in copending patent application Nos. 08/561,889 and 08/672,096 and can also be accomplished by the use of software algorithms. See U.S. Pat. No. 4,984,276. In some existing systems, a dedicated digital signal processor (DSP) is used to provide the computing power needed to perform the extensive processing required for the sound synthesis algorithms. DSP based synthesizer equipment is also highly specialized and expensive. See U.S. Pat. No. 5,376,752, for example.

With the increased power of the central processing units (CPUs) that are now built into personal computers (PCS), a PC can take in a MIDI command stream, perform the synthesis algorithms, store a digital representation of the music, and then convert the digital codes to an audio signal using a coder/decoder (CODEC) device.

Because the SSSS can use any of a number of synthesis techniques to emulate an instrument, it can for example, reproduce a piano using waveform synthesis on one channel while reproducing a clarinet on a different channel with physical modeling. Similarly, two or more layered voices on the same channel can be generated with the same technique or using different techniques. And, when the MIDI stream contains a channel program change for a different instrument, the new instrument voice can be automatically switched to a different synthesis algorithm. Using the MIDI standard, the SSSS can generate a compact digital representation of music that contains not only the information that describes the particular note, duration, and instrument voice, but also the synthesis technique and special effects processing required to accurately reproduce it. What is needed however, is a standard file format for recording the digital representation produced by the SSSS so that any playback machine will be able to interpret the data and re-create the music as originally synthesized.

The growth in popularity of the Interact as a communications medium is clear from the rapid increase of personal computers that are now able to connect to it. However, one limitation of this medium is that most users gain access to the Internet via relatively low speed connections. Most schemes for transmitting audio today involve sending recorded audio that has been digitized and compressed. Sending one minute of Compact Disc (CD) quality audio over the Internet, for example, can require up to ten megabytes of data storage. Receiving one megabyte of audio using a typical 14.4 kb modem takes over an hour. Because of the size of digital audio, it generally needs to be dramatically scaled down in quality, i.e. from CD audio quality to transistor AM radio quality, to be small enough to transmit in a reasonable amount of time. Thus, an average length ten minute piece of music recorded at the industry standard CD sampling rate as a digital encoding of analog sound waves could easily require 100 megabytes of data. An Internet user can not be expected to wait the four days required to download the ten minute piece of music. There is a further need to represent music accurately and in a compact format so that the high fidelity representation can be transferred over a narrow bandwidth medium like the Internet in a reasonable amount of time.

Ironically, much of the recorded audio sent over the Internet today is created using MIDI tools. A composer often assembles a variety of synthesizers to give him the necessary instruments for a composition. Using sequencing software (which is like a word processor for musical notes) the music is composed and edited. The end result is a very small MIDI file which is equivalent to "electronic sheet music" for the composition. A three minute piece of music can be expressed in a 20 kb MIDI file.

As the final step in creating a composition, the MIDI file is "run" (like a software program) on a specially programmed MIDI synthesizer and, as the music is played, it is digitally recorded. The composer does not want to distribute the MIDI file itself because it only represents part of his total composition. The pre-programming of his MIDI synthesizer is the missing part not included in the standard MIDI file. The pre-programming allows the composer to modify the voices of the instruments contained in the general MIDI library or create his own voices. Without the pre-programming information, the MIDI file would sound different on differently programmed synthesizers. Thus, composers currently digitally record their MIDI files as the files play on their own pre-programmed synthesizers. It is this digital recording of the music that is then compressed and transmitted over the Internet.

The software sound synthesis system described in the aforementioned copending patent applications and discussed above creates a representation of the information preprogrammed into a composer's synthesizer. Thus, if this information could be captured and integrated into the file containing the standard MIDI commands, then not only could a composer store and distribute the notes of his composition, but he could also store and distribute the voices he chose to play the notes. The composer would in this way be able to insure that his composition would sound exactly the same on anyone else's MIDI playback machine configured with a SSSS.

A music composer using the SSSS would naturally like to be able to distribute his composition over the Internet to others, however, current MIDI standards are limiting in that the special controls possible with the SSSS, e.g. choice of synthesis algorithms, special wavetable data, etc. which the composer has designated can not be readily transmitted using standard MIDI data files.

Frequently it is difficult to entice Internet users to download large files due to the long delay resulting from the limited bandwidth available. Further, searching through online collections of graphics files can be tedious and time consuming because it is necessary to download an entire file just to find out it is not the one desired. These problems have been overcome with regard to graphics files by the development of a file transfer protocol that allows the server to stream the graphics data file to the requesting client. Thus, the client is able to display the file in the foreground as it arrives in the background. The resolution of the picture gradually improves as more data arrives. It is no longer necessary to wait for the entire graphics file to be received to begin viewing it. The user is able to cancel the transfer once enough of the file has arrived that he recognizes he is not interested in waiting for the remainder of the file to be transferred.

As with graphics files, it can be tedious and time consuming to first download an audio file only to discover, once the entire file has arrived, that it is not a file the user is interested in receiving. What is yet further needed is a way, analogous to graduated resolution enhancement of downloading graphics files, to stream a music data file over the Internet to a requesting client. This would require both a means to begin playback as soon as the first bytes of the music data file arrive and a method to gradually improve the "resolution" or fidelity of the audio playback as more data arrives.

Once a user identifies that a particular file is one he would like to download, there exists additional problems. The presently available means of representing music either require huge files, significantly degraded fidelity, or compositions with very limited instrumentation. What is needed is a means of representing music containing complex instrumentation in relatively short files without any loss of musical fidelity.

SUMMARY QF THE INVENTION

The above and other objects of the invention are achieved by the present invention of a music composition/playback and compression technology for networks including the Internet which provides three important capabilities: It is (1) high quality (i.e., CD-Audio quality) playback via lossless compression, (2) effectively instantaneous (via a buffering scheme) playback, and (3) custom instrumentation, not prerecorded or "canned music" from another source. SSSS as modified according to the present invention includes three components: (1) a composer unit for the network server, (2) the transmission file format and transmission protocol, and (3) a receiving unit, including playback software for the network client.

The Server-Composer PC is programmed as a music authoring tool with which users compose music on a PC in a very straight forward manner. The output of SSSS Server-Composer is a music data file (referred to hereinafter as a CyberMIDI file or an MDF) which contains all the information to play back identical music on the Client-Player PC using the Sound Synthesis System. Both the Server-Composer and Client-Player technologies are based on the SSSS described in the aforementioned copending patent application Nos. 08/561,889 and 08/672,096, and are essentially identical.

The CyberMIDI file format is used by SSSS Server-Composer and SSSS Client-Player to send signals representative of compressed custom music over the Internet via TCP/IP in the following predefined order: (1) enhanced MIDI data, (2) SSSS voicing parameters, and (3) custom wavetable data. In addition, the SSSS transmission protocol "buffers" the CyberMIDI data and treats it as "streaming" so that the beginning of a MIDI file begins playing while the balance of the MIDI data is received in the background, and (2) substitutes algorithms and General MIDI (GM) voices for custom wavetable instruments downloading in the background. These two features provide "instant playback" of music from a web page, and "graceful upgrading" of the instrument voices as custom wavetable and/or programming download in the background The Client-Player PC is a driver-level SSSS playback engine which responds to CyberMIDI data. The SSSS Client-Player is configured as an "Internet ready" application, fully integrated into a variety of internet browser environment formats, including Netscape Navigator (a trademark of Netscape Communications Inc.) as a Plug-in, Microsoft Explorer as an ActiveX Controls (trademarks of Microsoft, Inc.), and Sun Microsystems' Java (a trademark of Sun Microsystems) as an applet.

Thus, the encoding of the music includes storing in a first file MIDI commands defining the music that can be accurately represented using MIDI standard music commands; determining MIDI standard instruments that provide the best approximation for the music that is not played by MIDI standard instruments; storing in a second file MIDI commands defining the music that best approximates the music originally played by non-MIDI standard instruments; and creating a third data file by incorporating the first and second files. This third file contains a plurality of fields including a first field having a representation of the entire piece of music using only MIDI standard instruments; and a second field having data containing voicing parameters and custom wave table information for recreating the original music created using non-MIDI standard instruments.

When a composition is completed using the SSSS Server-Composer, users can "post" the finished CyberMIDI file as an icon (labeled as a CyberSound™ icon) into a web page. Web page viewers anywhere in the world, utilizing the SSSS Client-Player can then listen to high quality, instantaneous, custom music by simply clicking on the CyberSound icon in the web page.

More specifically, the compression achieved with this method is substantial. Using the present invention, the size of the data file required to accurately represent a musical composition containing complex instrumentation can be compressed on the order of 1000-to-1. At the same time, the compression is "lossless". No information is discarded in compressing the music. The playback machine is able to faithfully reproduce the original composition without any loss of fidelity. Decoded music played on the Playback PC, once the full complement of custom wavetable data is transferred and buffered into the Playback PC in the background, sounds identical to the original composition. Both the method and system of the present invention depend upon the application of software that provides several functions. The software facilitates the composition of music on the Composer PC using the Software Sound Synthesis System, encodes the composed music for network transmission (resulting in a file which is a unique permutation of the MIDI communications protocol), transmits the encoded music over any computer network Ethernet, Internet, Intranet, Token Ring, etc., and decodes the transmitted music on the "Playback PC" with technology that mirrors the functionality of the encoding environment. In other words, the Playback PC faithfully reproduces the specific music performance originally created on the Composer PC. The invention provides the following capabilities: music authoring, compression encoding, computer network transmission, compression decoding, and music playback.

Lossless music transmission requires both a software-based music generation capability common to both the Composer PC and the Playback PC, and a unique compression encoding scheme that captures every aspect of the music performance including articulations, unique instrument data, use of unique synthesis types, and numerous other parameters, for transmission and playback over various different types of computer networks.

The foregoing and other objectives, features and advantages of the invention will be more readily understood upon consideration of the following detailed description of certain preferred embodiments of the invention, taken in conjunction with the accompanying drawings.

BRIEF DESCRIPTION OF THE DRAWINGS

FIG. 19(*b*) is a diagram of the track chunk format of a standard MIDIfile.

DETAILED DESCRIPTION OF THE PREFERRED EMBODIMENT

Figure 1:
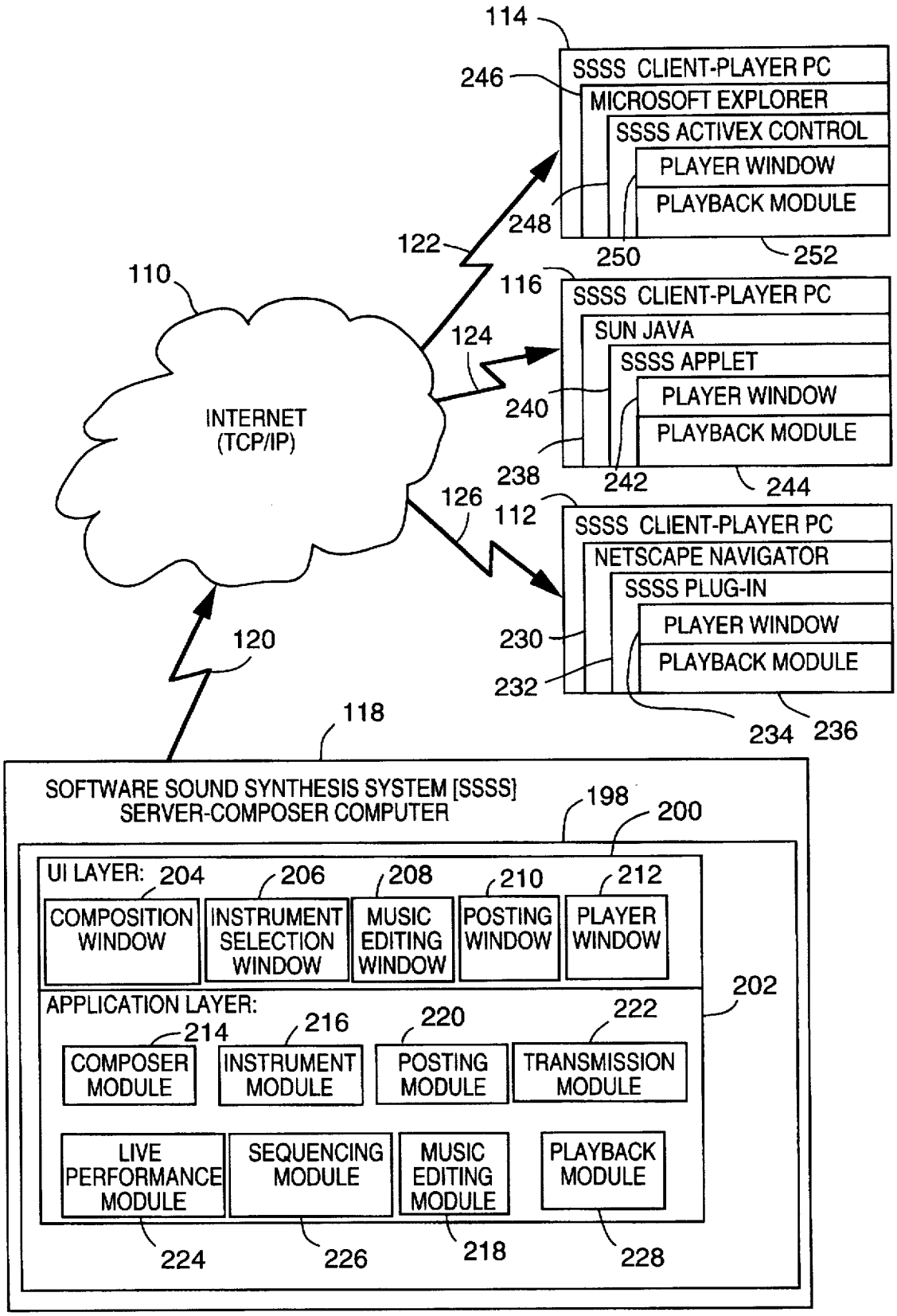
FIG. 1 is a block diagram depicting a system for streaming transmission of enhanced MIDI commands over the Internet.

Turning to FIG. 1, the present invention is a method for compressing and transferring music data files from a Server-Composer computer 118, over the Internet 110 or any network, to any number of Client-Player personal computers (PCS) 112, 114, 116 such that the transmission time is relatively short because the file size is relatively small and the music begins to play immediately upon arriving at a Client-Player PC 112. Even though a substantial portion of the data file may not have arrived at the Client-Player PC 112 or even been transmitted by the Server-Composer computer 118, the Client-Player PC 112 is able to begin playback of a nearest approximation of the music. As more data arrives at the Client-Player PC 112, the accuracy of the playback is gradually improved until the playback is an exact reproduction of the original composition. The present invention accomplishes this despite the fact that the various network connections 120, 122, 124, 126 can be as slow as 14.4 kb.

The method is supported by a network transfer and compression system that includes three principle components: (1) the SSSS that runs on the Server-Composer computer 118, (2) the transmission protocol which includes the transmission file format, and (3) the playback software for the Client-Player PC 112 which is essentially the same SSSS running on the Server-Composer 118.

I. Software Sound Synthesis System & The Server-Composer Computer

In the preferred embodiment, the Server-Composer computer 118 includes a music file stored in its storage medium 24 that has been encoded according to the procedure depicted in FIG. 2, which will be explained further herein. As an Internet server, the Server-Composer computer 118 is available to any Client-Player PC 112, 114, 116 connected to the network 110 that is able to connect to the Server-Composer computer's 118 Internet Protocol (IP) address or any other network protocol address. The Server-Composer computer 118 includes a music authoring tool 198 which allows composition of music on a PC in an intuitive manner. It is this program that can generate the encoded music data file which contains all the information necessary to playback identical music on a Client-Player PC 112. In this system, both the Server-Composer 118 and Client-Player 112 technologies are based on the SSSS disclosed in U.S. application Ser. Nos. 08/561,889 and 08/672,096 and are essentially identical. They function like two mirror image synthesizers connected via long-distance MIDI.

The SSSS Server-Composer computer 118 authoring user interface (UI) 200 is simple, easy-to-use, and graphically based. The primary windows include (1) a "clip music" style composition window 204, (2) an instrument selection window 206 which includes being able to switch instruments while the music is playing, (3) an editing music window 208 which allows drag-and-drop editing of notes on a music staff, and (4) a posting window 210 which allows a music data file to be posted as an icon on a web page, and (5) a player window 212 which allows control of the playback of the music data file.

The Composition UI display window 204 gives users the ability to select from different music styles, tempos, key signatures, etc. Selections are made via a combination of icons and pull-down/pop-up option lists.

The Instrument Selection UI display window 206 gives users the ability to select any instrument (wavetable or synthesized) and assign it to a music line. Within each instrument selection a user can also set basic parameters of the instrument's voicing. For example, for each instrument the user can choose the sharpness of the attack, the reverberation, the equalization, or a filter to apply.

The Music Editing UI display window 208 gives users the ability to view a music staff and move notes with a mouse to change the music they have created. With this window users can change several aspects of the music including notes, key signatures, and tempo.

The Posting UI display window 210 gives users the ability to "post" their music data file (i.e., the complete composition) as a CyberSound™ icon on an Internet 110 web page.

The Player UI display window 212 gives users the ability to stop and start playback of the music data file. The display indicates how much of the composition has played, how much remains, and supplies traditional CD-player type GUI controls.

Figure 4:
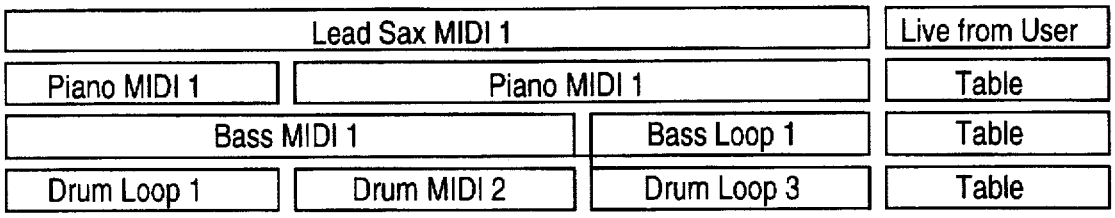
FIG. 4 is a block diagram depicting a multi-channel MIDI music composition before it is encoded into a transmission music data file according to the method depicted in FIG. 2.

There are a number of software application modules 202 running on the SSSS Server-Composer computer 118 that are controlled by the UI windows 200 discussed above. A Composer Module 214 provides the capability to select and assemble music "segments" from a wide variety of music styles as shown in FIG. 4. An intro, verse, and bridge, can be chosen and "pasted" together as icons. The length of the music is determined by the user. MIDI files are assembled to create the desired music.

An Instrument Module 216 provides the capability to select any instrument to be assigned to any MIDI channel being played. The selection can be made in real-time such that the music changes while the user is listening.

A Live Performance Module 224 provides the capability to connect a MIDI controller to a SSSS enabled computer and "play" the synthesizer externally. Live Performance Module 224 options enables users to select any instrument from an extensive general MIDI (GM) superset library to play as part of the music being composed. For example, a user might select a drum loop and a MIDI bass line loop. He can then perform a live electric piano along with the drum and base line loops.

A Sequencing Module 226 provides the capability to capture notes in a live performance and edit them, as will be described below. The sequencing code 226 also provides the capability to load and play MIDI files from an external source, like the Internet 110. These files can also be edited, as will be described below.

A Music Editing Module 218 provides the capability to edit MIDI data, whether it originated as a series of pasted together MIDI files, a live performance, or a downloaded MIDI file. Standard sequencer editing features are included, including the ability to manipulate pitch, tempo, and overall key signature.

Figure 5:
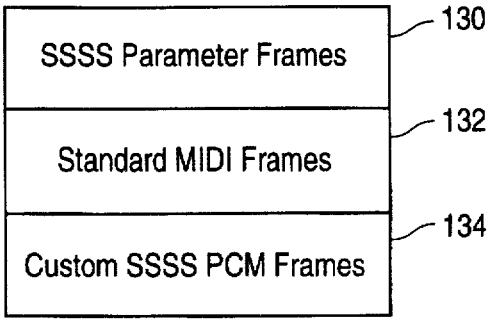
FIG. 5 is a conceptual block diagram of the file structure of a CyberMIDI music data file representative of music according to the present invention.

A Posting Module 220 provides the capability to assign the CyberMIDI MDF to an icon in the developer's Internet 110 web page. Referring to FIG. 5, the MDF consists of MIDI data 132, synthesis voicing parameters 130, and wavetable content 134. The MDF is assigned to the CyberSound icon and "pasted" into the developer's web page via Hyper Text Mark-up Language (HTML) or in a standardized way within any number of What-You-See-Is-What-You-Get (WYSIWYG) web page composition packages, like Vermeer Front Page, Adobe PageMill or Netscape Navigator Gold. When a composition is completed using the SSSS, users can post the finished encoded music file as an icon into a web page. Web page viewers anywhere in the world, utilizing the SSSS, can then listen to high quality, instantaneous, custom music by simply clicking on the posted icon in the web page.

A Transmission Module 222 provides the capability to transmit the MDF via TCP/IP over the Internet 110. The Transmission Module assembles the parts of the MDF into a specific predefined order and format to facilitate the immediate playback and graduated fidelity features of the present invention. This module, while part of the SSSS application software 198 in the best mode embodiment, will be discussed in detail in section II of this specification.

A Playback Module 228, 236, 244, 252 provides the capability to play the MDF as it arrives on the Client-Player PC 112. As with the Transmission module 222, this module is part of the SSSS application software 198 in the best mode embodiment but will be discussed in detail in the section III of this specification.

Figure 8:
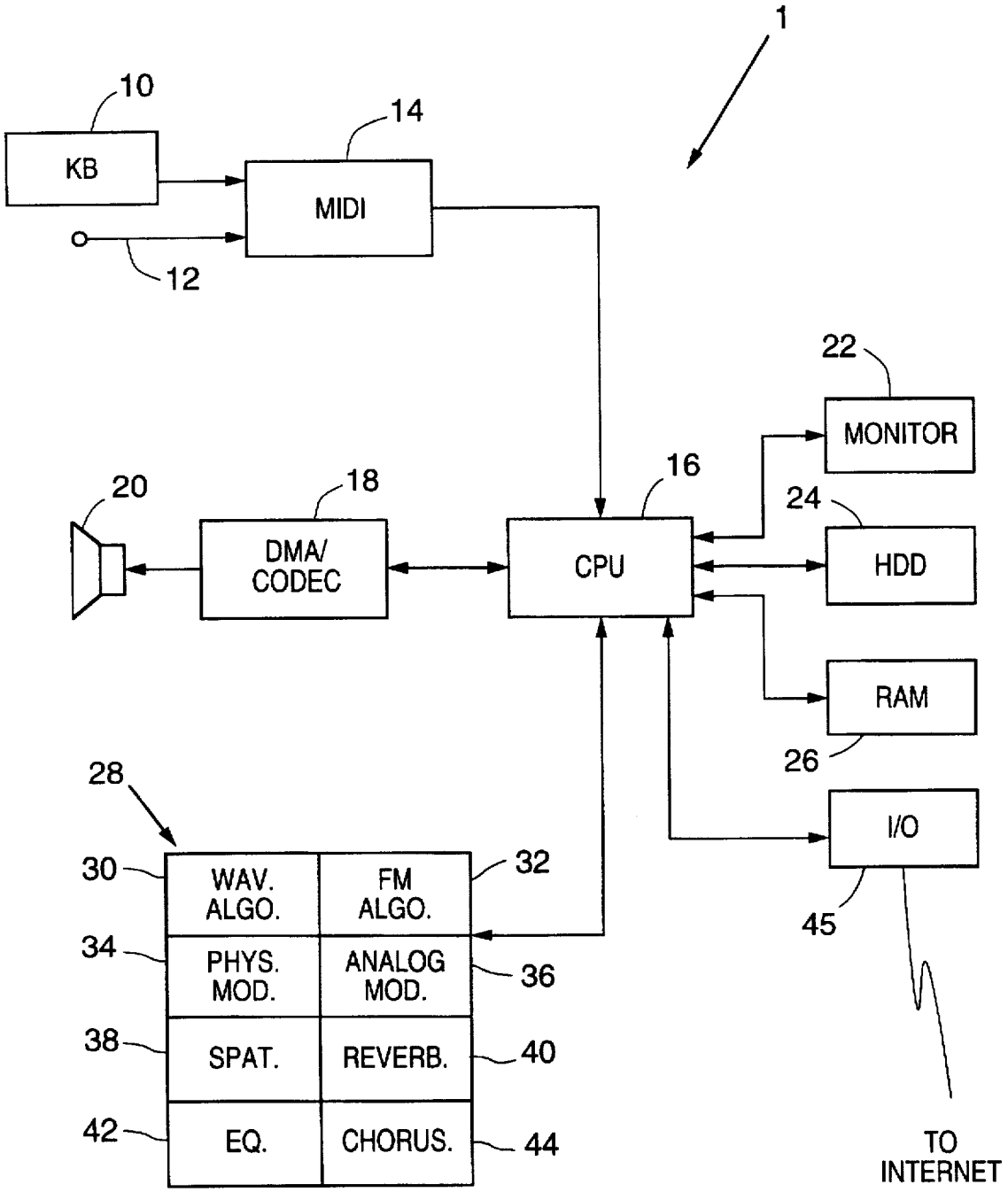
FIG. 8 is a block diagram of a SSSS as used in the present invention.

Turning now to FIG. 8, the SSSS will be discussed in detail. This system is embodied as a programmed personal computer 1 that takes advantage of the increased processing power of PCS to synthesize high quality audio signals. It also takes advantage of the greater flexibility of software to implement multiple synthesis techniques simultaneously. In addition, because the software generates music in response to real time command inputs, it implements a number of strategies for graceful degradation of the system under high command loads. The personal computer 1 can access the Internet 110 via an input/output (I/O) interface 45. This I/O interface 45 can be embodied as local area network (LAN) adapter that leads to an Internet gateway, a serial card connected to a modem that can dial into an Internet gateway, or any other usual means for connecting to the Internet 110 (or the particular type of network over which transmission is desired).

The SSSS is comprised of a MIDI circuit 14 connected to a real time data input device, e.g. a musical keyboard 10. Alternatively, the MIDI circuit 14 can be supplied with voice signals from other sources, including sources, e.g. a sequencer (not shown), within the computer 1. The term "voice" is used herein as a term of art for audio synthesis and is used generally herein to refer to digital data representing a synthesized musical instrument.

The MIDI circuit 14 supplies digital commands in real time asynchronously over a plurality of channels to a central processing unit (CPU) 16 which stores them in a circular buffer. The CPU 16 is connected to a direct memory access (DMA) buffer/CODEC circuit 18 which is connected, in turn, to an audio transducer circuit, e.g. a speaker circuit 20 which is represented in the figure as a speaker but should be understood as representative of a music reproducing system including amplifiers, etc. Also connected to the CPU and controlled by it are a display monitor 22, a hard disk drive (HDD) 24, and a random access memory (RAM) 26.

As will be explained in further detail hereinafter, when the CPU 16 receives a MIDI command from the MIDI circuit 14 designating a particular key or switch on the keyboard 10 which has been depressed by an operator, the CPU 16 synthesizes one or more voices for each of the channels in response to the MIDI commands, each of the voices being generated by one or more audio synthesis algorithms 30 including a wavetable algorithm 28, a frequency modulation algorithm 32, an analog algorithm 36, and a physical model algorithm 34. It is to be understood that although the algorithms 30 are depicted as discrete elements, they are implemented in software. Also, it should be understood that the same algorithm can be used to synthesize voices received on different MIDI channels.

In addition to the basic tone generation described above, the software system is capable of performing real time effects processing using the CPU 16 of the PC rather than the dedicated hardware required by prior art devices. Conventional systems utilize either a dedicated DSP or a custom VLSI chip to produce echo or reverberation ("real time") effects in the music. In the present program, software algorithms are used to produce these effects. The software program can calculate the effects in the CPU 16 of the PC and avoid the additional cost of dedicated hardware. During the effects processing, the digital voice data synthesized by the CPU using the one or more audio synthesis algorithms can be further subjected to spatialization processing 38, reverberation processing 40, equalization processing 42, and chorusing processing 44, for example.

Because the synthesizer process is intended to run in a PC environment, it must coexist with other active processes and is thus limited in the amount of system resources it can command. Furthermore, the user can optionally preset a limit on the amount of memory that the synthesis process may use.

In addition, for some algorithms, such as waveform sampling, the data required to be downloaded from disk in order to generate a tone may be huge, thus introducing significant data transfer delays. Also, the generation of a tone may require a high number of complex calculations, such as for physical modeling or FM synthesis, thus consuming CPU time and incurring delays. The resources required to generate the sound waveform for a command can exceed the processing time available or the tone cannot be generated in the time needed for it to appear to be responsive to the incoming command.

The processing environment and user imposed limits on available resources, as well as the requirements inherent in producing an audible tone in response to a user's keystroke, have led to a series of optimization strategies in the present system which will be discussed in greater detail hereinafter.

Figure 9:
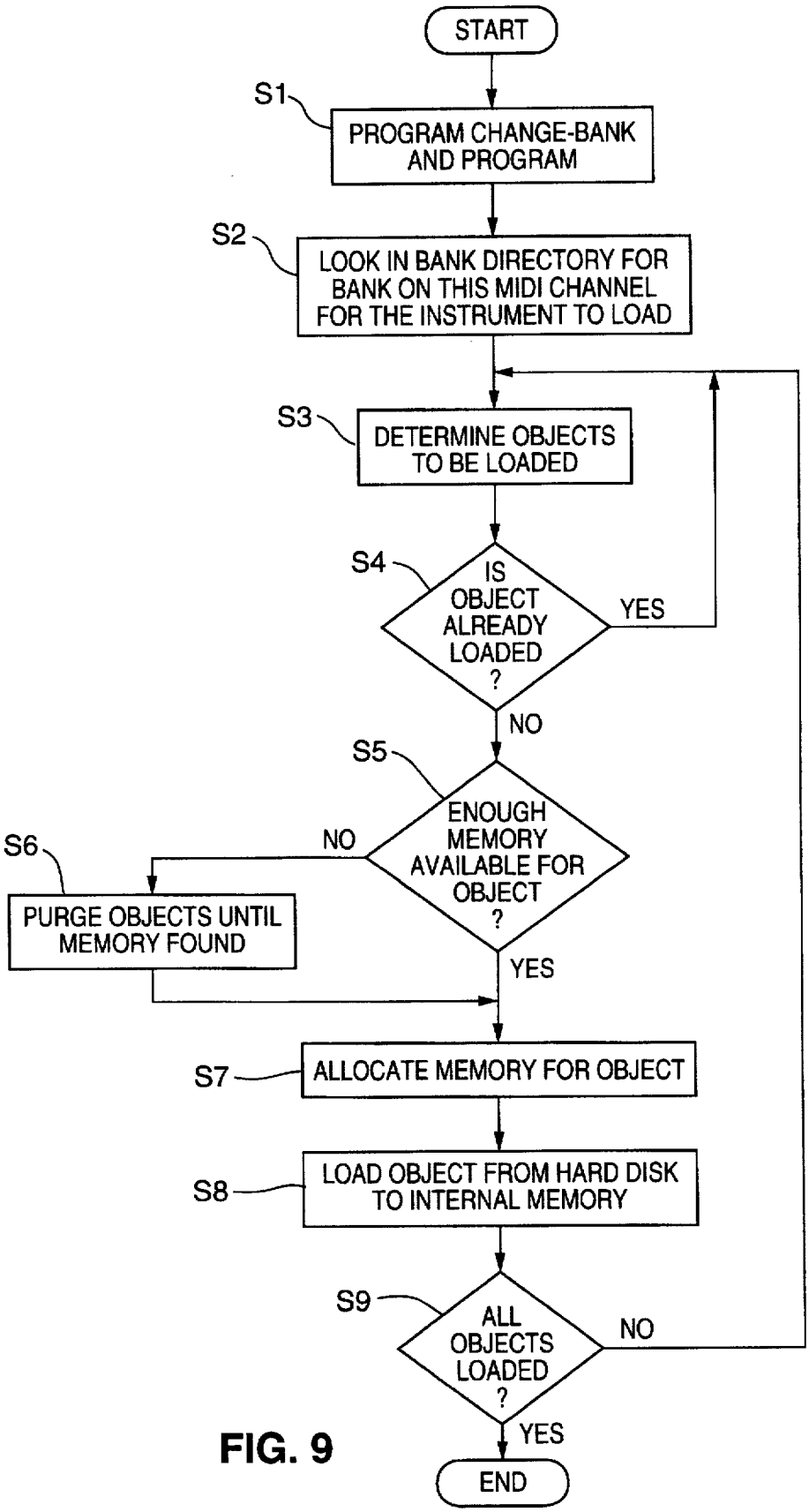
FIG. 9 is a flow chart for a PROGRAM CHANGE AND LOADING INSTRUMENTS routine performed by the central processor shown in FIG. 8.

Referring now more particularly to FIG. 9, the CPU 16 initially executes the PROGRAM CHANGE AND LOADING INSTRUMENTS routine. This routine is normally carried on in background, rather than in real time. At step S1 the CPU 16 loads from the HDD 24 the sound synthesizer program, including some data directory (so-called bank directory) files, into the RAM 26. At step S2, the CPU 16 looks in a bank directory of the data on the HDD 24 for the particular group of instruments specified by a MIDI command received from the MIDI circuit 14. It should be understood that each bank comprises sound synthesis data for up to 128 instruments and that multiple bank directories may be present in the RAM 26. For example, one bank might be the sound data appropriate for the instruments of a jazz band while another bank might the sound data for up to 128 instruments appropriate for a symphony.

Figure 10:
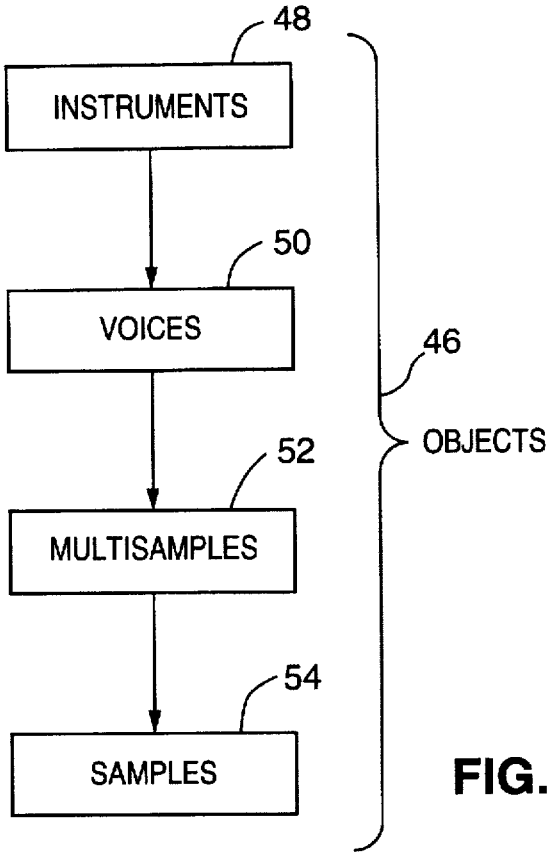
FIGS. 10, 11, and 12 are illustrations for use in explaining the organization of the synthesized voice data utilized by the SSSS shown in FIG. 8.

At step S3, the CPU 16 determines the objects for the particular instrument to be loaded. The objects can be thought of as blocks of memory which can be kept track of by the use of caches. Referring to FIG. 10, an object block 46 can be an instrument block 48, a voice block 50, a multisample block 52 or a sample block 54. Each of the blocks 48 to 54 in FIG. 10 represents a different cache in memory related to the same instrument. The specified instrument data block 48 further points to a voice data block 50. The voice data block 50 qualifies the data for the instrument by specifying which of the sound synthesis algorithms is best employed to generate that instrument's sound, e.g. by a wavetable algorithm, an FM algorithm, etc., as the case may be. The designation of the best algorithm for a particular instrument, in the present invention, has been predetermined empirically, however, in other embodiments the user can be asked to choose which synthesis algorithm is to be used for the instrument or can choose the algorithm interactively by trial and error. Also included in the voice data are references to certain qualifying parameters referred to herein as multisamples 52.

The multisamples 52 specify key range, volume, etc. for the particular instrument and point to the samples 54 of pulse code modulated (PCM) wave data stored for that particular instrument. As will be explained in greater detail hereinafter, it is this PCM data which is to be processed according to the particular sound synthesis algorithm which has been specified in the voice data 50.

Figure 11:
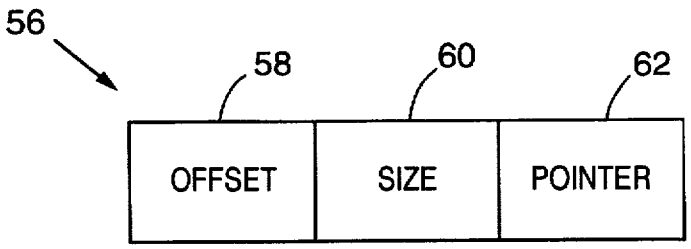
Figure 12:
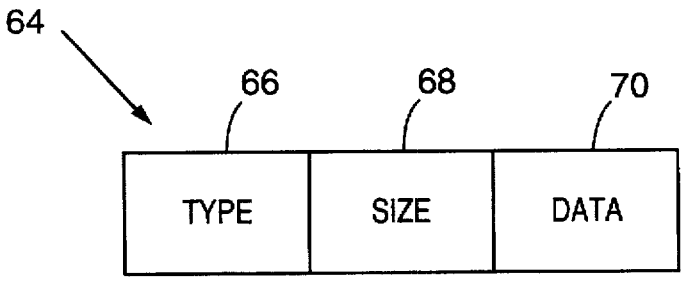

Referring to FIGS. 11 and 12, the organization of the objects 46 will be explained. The CPU 16 references objects by referring to an object information structure 56 which is organized into an offset entry 58, a size entry 60, and a data pointer 62. The offset entry 60 is the offset address of the object from the beginning of the file which is being loaded into memory. The size entry 60 has been precalculated and denotes the file size. These two entries enable the CPU 14 to know where to fetch the data from the files stored in the HDD 24 and how big the buffer must be which is allocated for that object. When the object is loaded from the HDD 24 into RAM 26, the pointer 62 will be assigned to the address in buffer memory where the object has been stored.

The object header 64 is the structure in the original file on the HDD 24 at the offset address 58 from the beginning of the file. It is constituted of a type entry 66, which may denote an instrument designation, a voice designation, a multisample designation, or a sample designation, i.e. it denotes the type of the data to follow, a size entry 68 which is the same as the size entry 64, i.e. it is the procalculated size of the data file, and lastly, the data 70 for the type, i.e. the data for the instrument, voice, multisample, or sample.

Referring again to FIG. 9, after step S3, the CPU 16 at step S4 checks if a particular object for the MIDI command has been loaded. The CPU 16 can readily do this by reviewing the object information entries and checking the list of offsets in a cache. If the object has been loaded, the CPU 16 returns to step S3. If not, the CPU 16 proceeds to step S5.

At step S5 the CPU 16 makes a determination of whether sufficient contiguous RAM is available for the object to be loaded. If the answer is affirmative, the CPU 16 proceeds to step S7 where sufficient contiguous memory corresponding to the designated size 64 of the data 70 is allocated. Thereafter at step S8 the CPU 16 loads the object from the HDD 24 into RAM 26, i.e. loads the data 70, determines at step S9 if all of the objects have been loaded and, if so, ends the routine. If all of the objects have not been loaded, the CPU 16 returns to step S3.

At step S5, if there is a negative determination, i.e. there is insufficient contiguous memory available, then it becomes necessary at step S6 to purge objects from memory until sufficient contiguous space is created for the new object to be loaded. Thereafter, the CPU proceeds to step S7.

Figure 13:
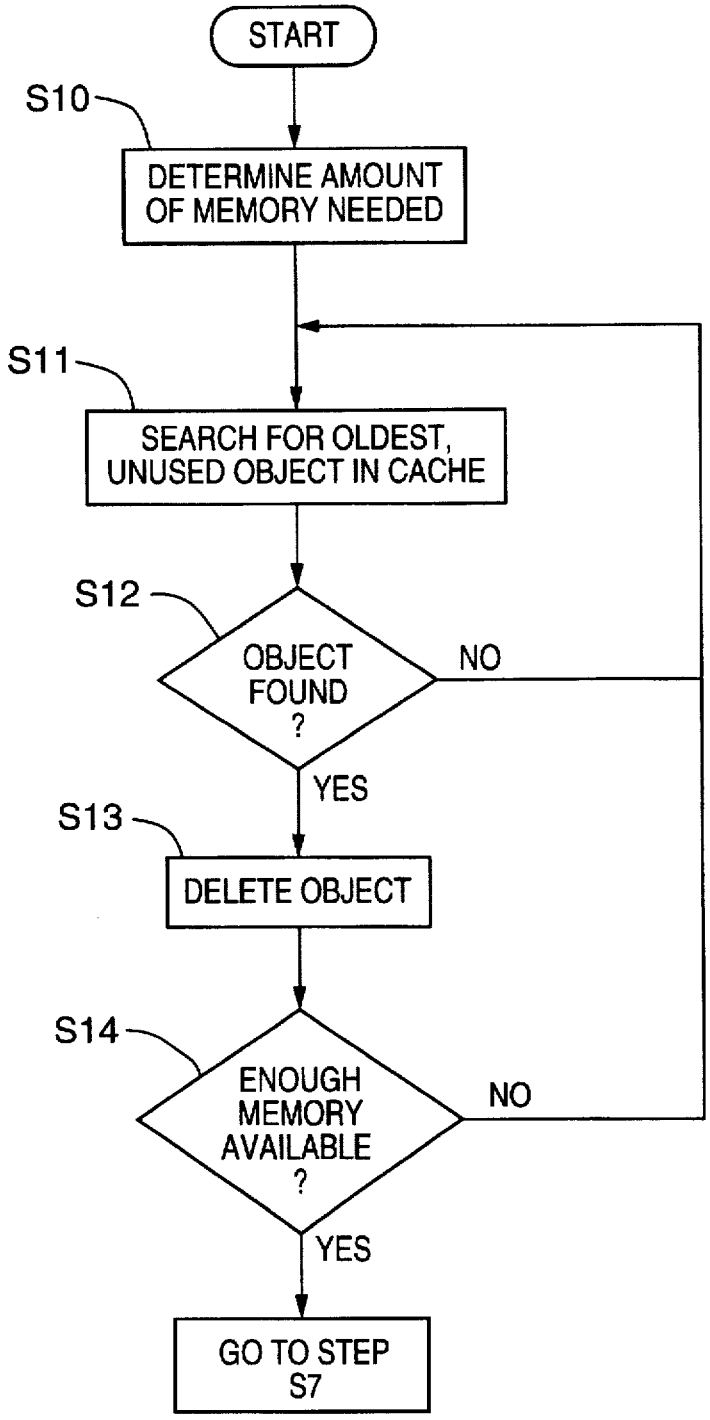
FIG. 13 is a flow chart for a PURGING OBJECTS subroutine performed by the central processor shown in FIG. 8.

In FIG. 13 the PURGING OBJECTS subroutine performed by the CPU 16 at step S6 is shown. At step S10 the CPU 16 determines the amount of contiguous memory needed by comparing the size entry 64 of the object information structure to the available contiguous memory. At step S11, the CPU 16 searches the cache in RAM 26 for the oldest, unused object. At step S12, the CPU 16 determines if the oldest object has been found. If not, the CPU 16 returns to step S11. If yes, the CPU 16 moves to step S13 where the found object is deleted. At step S14 the CPU 16 determines if enough contiguous memory is now available. If not, the CPU returns to step S11 and finds the next oldest, unused object to delete. Note that both criteria must be met, i.e. that the object is not in repeated use and is the oldest. If the CPU 16 finally provides enough contiguous memory by the steps S11–S14, the CPU 16 then proceeds to step S7 and the loading of the objects from the HDD into the RAM 26.

Figure 14:
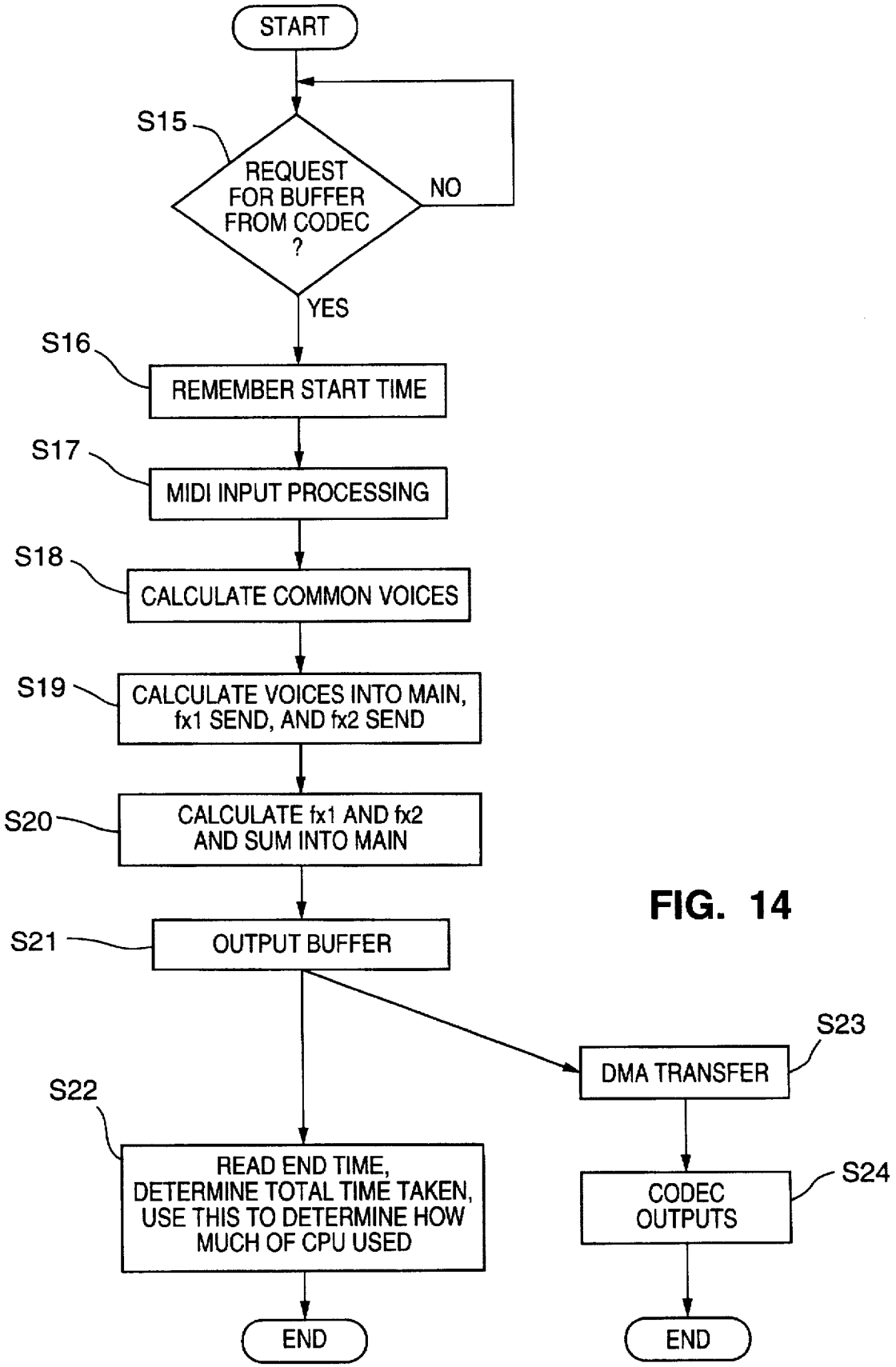
FIG. 14 is a flow chart for a VOICE PROCESSING routine performed by the central processor shown in FIG. 8.

During real time processing, i.e. when MIDI commands are generated to the CPU 16, the VOICE PROCESSING routine is performed by the CPU 16. Referring to FIG. 14, this routine is driven by the demands from the CODEC 18, i.e. as the CODEC outputs sounds it requests the CPU 16 to supply musical sound data to a main output buffer in RAM 26. At a first step S15, a determination is made whether the CODEC has requested that more data be entered into the main buffer. If not, the CPU 16 returns to step S15, or more accurately, proceeds to perform other processes.

If the determination at step S15 is affirmative, the CPU 16 sets a start time in memory at step S16 and begins real time processing of the MIDI commands at step S17. The MIDI INPUT PROCESSING subroutine performed by the CPU 16 will be explained subsequently in reference to FIG. 15, however, for the moment it is sufficient to explain that the MIDI INPUT PROCESSING subroutine activates voices to be calculated by a designated algorithm for each instrument note commanded by the MIDI input commands.

In step S18, the CPU 16 calculates "common voices," by which is meant certain effects which are to be applied to more than one voice simultaneously, such as vibrato or tremolo, for example, according to controller routings set by the MIDI INPUT PROCESSING subroutine. At step S19, the CPU 16 actually calculates voices, including common voices, for each instrument note using a CALCULATE VOICE subroutine, which will be explained further in reference to FIG. 11, to produce synthesized voice digital data which is loaded into a main buffer, a first special effects (fx1) buffer, and a second special effects (fx2) buffer.

At step S20, using the data newly loaded to the fx1 buffer and the fx2 buffer, the CPU 16 calculates special effects for some or all of the voices, e.g. reverberation, spatialization, equalization, localization, or chorusing, for example, by means of known algorithms and sums the resulting digital data in the main buffer. The special effects parameters are determined by the user. At step S21, the CPU 16 outputs the contents of the main buffer to, e.g. the DMA buffer portion of the circuit 18 at step S23. The data is transferred from the DMA buffer to the CODEC at step S24 and is audibly reproduced by the system 20. In some PC's, however, this transfer of the main buffer contents to the CODEC would be accomplished by a system call, for example.

Following step S21, the CPU 16 also reads the end time for executing the VOICE PROCESSING routine, determines, by taking the difference from the time read at step S16 the total elapsed time for completing the routine, and from this information determines the percentage of the CPU's available processing time which was required. This is accomplished by knowing how often the CPU 16 is called upon to fill and output the main buffer, e.g. every 20 milliseconds. So, if the total elapsed time to fill and output the main buffer is determined to be, e.g. two milliseconds, the determination is then made at step S22 that 10% of the CPU's processing time has been used for the voice synthesizing program and 90% of the processing time available to the CPU is available to perform other tasks. As will be explained later in this specification, at a predetermined limit which can be selected by the user, the sound synthesis will be gracefully degraded so that less of the CPU's available processing time is required. The VOICE PROCESSING routine is then ended until the next request is received from the CODEC.

Figure 15:
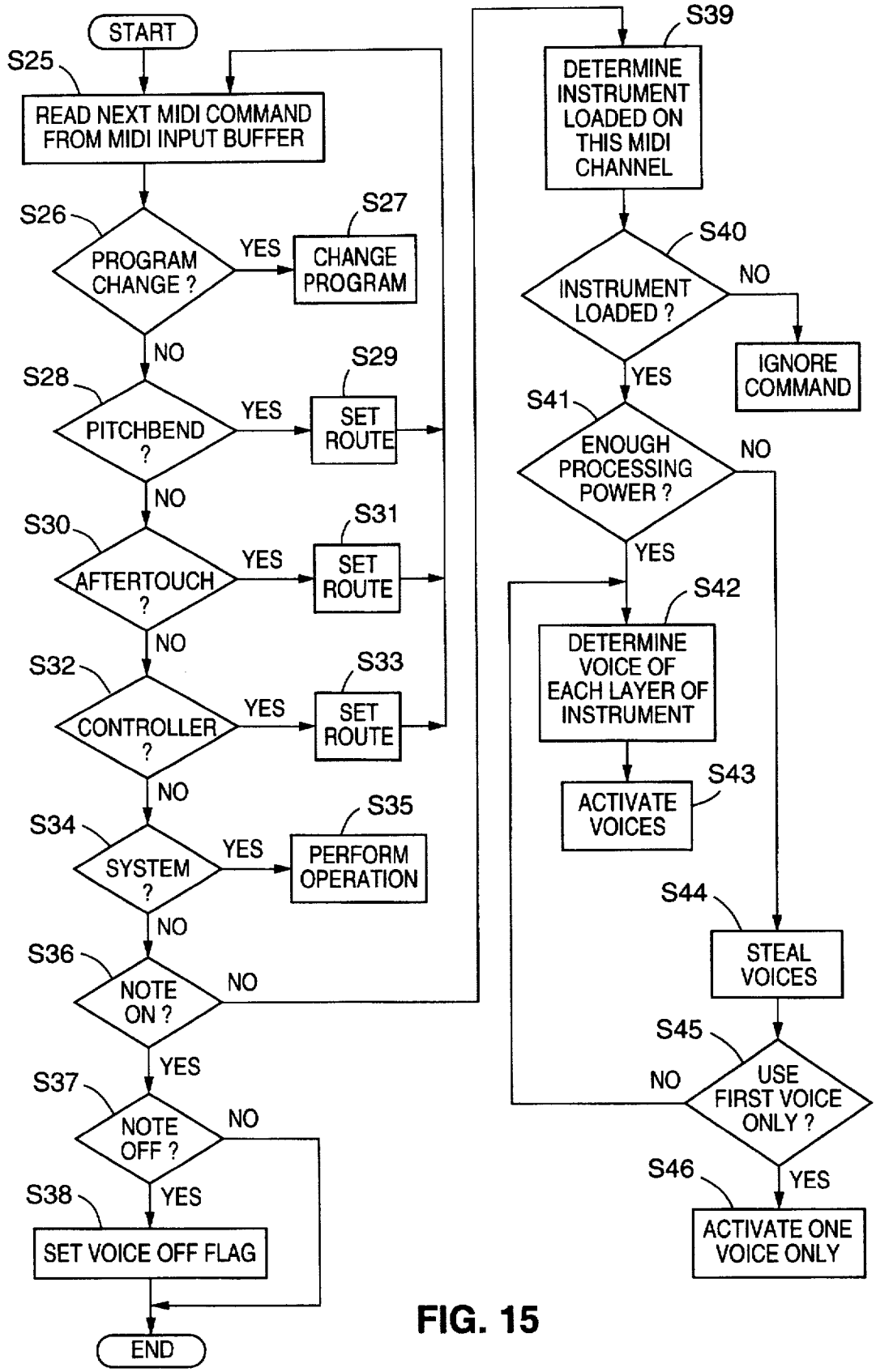
FIG. 15 is a flow chart for a MIDI INPUT PROCESSING subroutine performed by the central processor shown in FIG. 8.

Referring now to FIG. 15, the MIDI INPUT PROCESSING subroutine which is called at step S17 will now be explained. MIDI commands arrive at the CPU 16 asynchronously and are cued in a circular input buffer (not shown). At the first step S25, the CPU 16 reads the next MIDI command from the MIDI input buffer. The CPU 16 then determines at step S26 if the read MIDI command is a program change. If so, the CPU 16 proceeds to make a program change at step S27, i.e. performs step S1 of FIG. 9. The CPU determines in the next series of steps whether the MIDI command is one of several different types which may determine certain characteristics of the voice. If one of such commands is detected, a corresponding controller routing to an appropriate algorithm is set which will be used during the ACTIVATE VOICE subroutine. That is, algorithms which use as one modulation input that particular controller are updated to use that controller during the ACTIVATE VOICE subroutine. Such routing will now be explained.

A "routing" is a connection form a "modulation source" to a "modulation destination" along with an amount. For example, a MIDI aftertouch command can be routed to the volume of one of the voice algorithms in an amount of 50%. In this example, the modulation source is the aftertouch command and the modulation destination is the particular algorithm which is to be affected by the aftertouch command. There is always a default routing of a MIDI note to pitch. Some possible routings are given in the table below:

TABLE I

| Modulation Sources | Modulation Destinations |
|---|---|
| MIDI Note | Pitch |
| MIDI Velocity | Volume |
| MIDI Pitchbend | Pan |
| MIDI Aftertouch | Modulation Generator Amplitude |
| MIDI Controllers | Modulation Generator Parameter[1] |
| Modulation Generator-Envelope | Algorithm Specific[2] |
| Modulation Generator-Low Frequency Oscillator (LFO) | Algorithm Specific[2] |
| Modulation Generator-Random | Algorithm Specific[2] |

[1]For envelope: attack, decay, sustain, release. For LFO: speed. For random: filter.
[2]For PCM synthesis algorithm: sample start, filter cutoff, filter resonance. For FM synthesis algorithm: operator frequency, operator amplitude. For analog synthesis algorithm: oscillator frequency, oscillator amplitude, filter cutoff, filter resonance. For physical modeling (PM)-clarinet: breath, noise filter, noise amplitude, reed threshold, reed scale, filter feedback.

A Modulation Generator Envelope is the predetermined amplitude envelope for the attack, decay, sustain, and release portion of the note which is being struck and can modulate not only volume but other effects, e.g. filter cutoff, as well. Note, that it is possible to have different envelopes with different parameters.

Each voice has a variable number of routings. Thus, an algorithm can be controlled in various ways. For a PCM synthesized voice, a typical routing might be:

Velocity routed to Volume

Modulation Generator Envelope routed to Volume

For an analog synthesized voice, a typical routing might be:

Velocity routed to Volume

Modulation Generator Envelope routed to Volume

Modulation Generator Envelope routed to Filter Cutoff.

Referring again to FIG. 15, assuming there is no program change detected, the CPU 16 proceeds to step S28 to detect if there is a pitchbend command. A pitchbend is a command from the keyboard 10 to slide the pitch for a particular voice or voices up or down. If a pitchbend command is detected, a corresponding pitchbend modulation routing to relevant algorithms which use pitchbend as an input is set at step S29. If no such command is detected, the CPU proceeds to step S30 where it is detected if an aftertouch command has been received. An aftertouch command denotes how hard a key on the keyboard 10 has been pressed and can be used to control certain effects such as vibrato or tremolo, for example, which are referred to herein as common voices because they may be applied in common simultaneously to a plurality of voices. If an aftertouch command is detected, a corresponding aftertouch modulation routing to relevant algorithms which use aftertouch as an input is set at step S31.

If no such command is detected, the CPU proceeds to step S32 where it is detected if a controller command has been received. A controller command can be, for example a "mod wheel," volume slider, pan, breath control, etc. If a controller command is detected, a corresponding controller modulation routing to relevant algorithms which use a controller command as an input is set at step S33. If no such command is detected, the CPU proceeds to step S34 where it is determined if a system command has been received. A system command could pertain to timing or sequencer controls, a system reset, which causes all caches to be purged and the memory to be reset, or an all notes off command. If a system command is detected, a corresponding action is taken at step S35. After each of steps S29, S31, and S33, the CPU 16 returns to step S25 for further processing.

If no such command is detected, the CPU proceeds to step S36 where it is determined if the command is a "note on," i.e. a note key has been depressed on the keyboard 10. If not, the CPU proceeds to step S37 where it is determined if the command is a "note off," i.e. a keyboard key has been released. If not, the CPU proceeds to the end. If a note off command is received, the CPU 16 sets a voice off flag at step S38.

If, at step S36, the CPU 16 determines that a note on command has been received, the CPU 16 proceeds to step S39 where it detects the type of instrument being called for on this MIDI channel. At step S40 the CPU 16 determines if this instrument is already loaded. If not, the command is ignored because, in real time, it is not possible to load the instrument from the HDD 24.

If the determination at step S40 is affirmative, the CPU determines next at step S41 if there is enough processing power available by utilizing the results of step S22 of previous VOICE PROCESSING routines.

Assuming the determination at step S41 is yes, at step S42 the CPU 16 determines the voice on each layer of the instrument. By this is meant that in addition to producing the sound of a single instrument for a command on a channel, the sound on a channel can be "layered" meaning that the "voices", or sounds, of more than one instrument are produced in response to a command on the channel. For example, a note can be generated as the sound of a piano alone or, with layering, both a piano and string accompaniment. Next, the CPU 16 activates the voices by naming the subroutine shown in FIG. 10 at step S43.

If, however, the CPU 16 finds insufficient processing power available at step S41, the CPU runs a STEAL VOICES subroutine at step S44. In the STEAL VOICES subroutine the CPU 16 determines which is the oldest voice in the memory cache and discards it. In effect, the note is dropped. Alternatively, the CPU 16 could find and drop the softest voice, the voice with the lowest pitch, or the voice with the lowest priority, e.g., a voice which was not producing the melody or which represents an instrument for which a dropped note is less noticeable. A trumpet, for instance, tends to be a lead instrument, whereas string sections are generally part of the background music. In giving higher priority to commands from a trumpet at the expense of string section commands, it is the background music that is affected before the melody.

At the next step S45, the CPU 16 determines, based on the processing power available, whether nor not to use the first voice only, i.e. to drop all other layered voices for that instrument. If not, the CPU 16 returns to step S42. If the decision is yes, the CPU 16 proceeds to step S46 where it activates only one voice using the ACTIVATE VOICE subroutine of FIG. 10.

Figure 16:
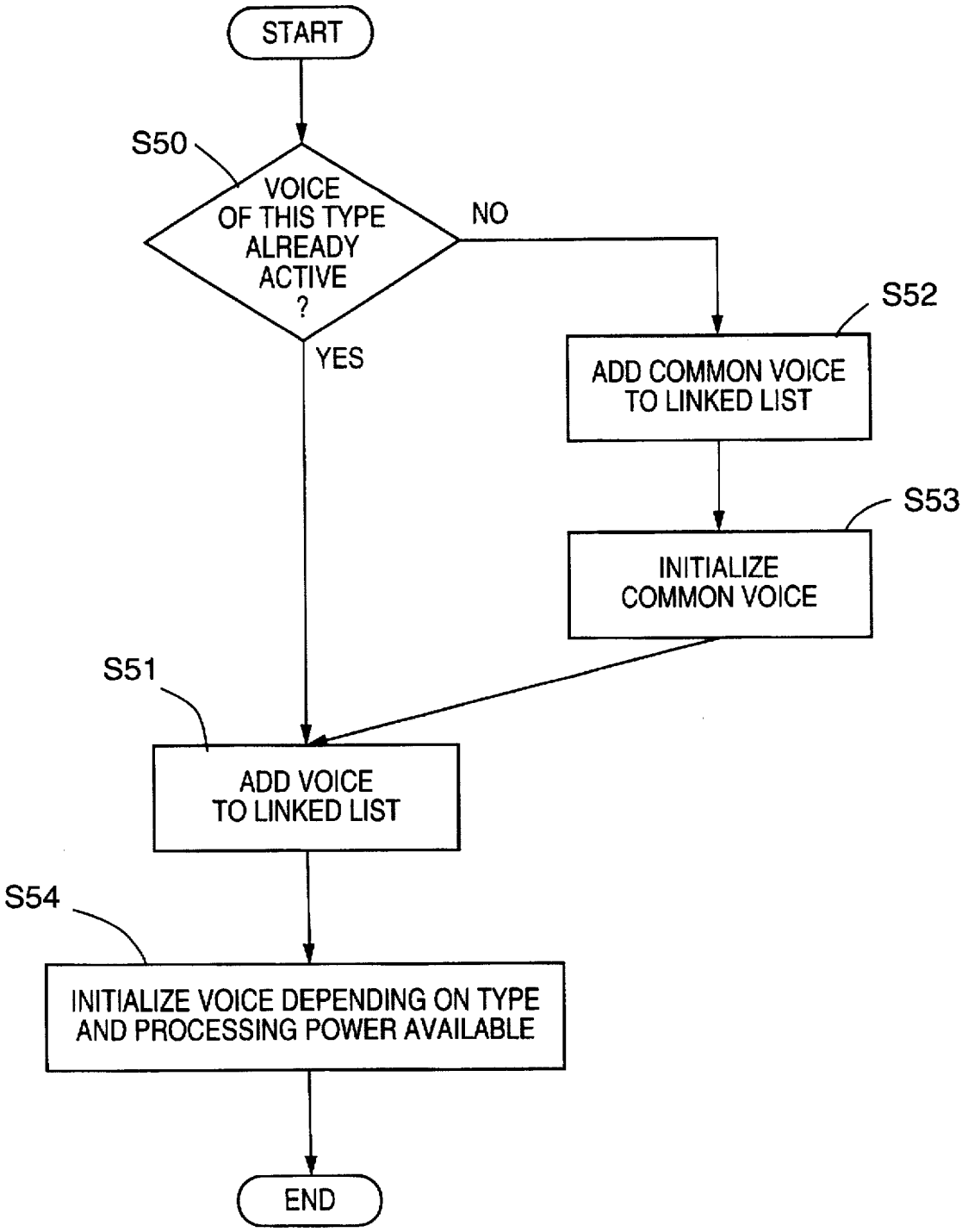
FIG. 16 is a flow chart for an ACTIVATE VOICE subroutine performed by the central processor shown in FIG. 8.

Referring now to FIG. 16, in the ACTIVATE VOICE subroutine, the CPU 16 determines at step S50 whether or not a voice of this type is already active. If so, the CPU adds the voice to a "linked list" at step S51. The concept of the linked list will be explained further herein in reference to FIG. 18. If the decision in step S50 is no, the CPU 16 adds a common voice, e.g. tremolo or vibrato, to the linked list at step S52, initializes the common voice at step S53, and proceeds to step S51.

Following step S51, at step S54, the CPU 16 initializes the voice depending on the type and the processing power which was determined at step S22 in previous VOICE PROCESSING routines. If insufficient CPU processing time is available, the CPU 16 changes the method of synthesis for the note. The algorithm for physically modeling an instrument, for instance, requires a large number of calculations. In order to reduce the resources required, or to produce the tone in the time frame requested for it, the tone that is requested may be produced using a less resource intensive algorithm, such as analog synthesis.

Also, some algorithms can be pared down to reduce the time and resources required to generate a tone. The FM synthesis algorithm can use up to 4 stages of carrier-modulation pairs. But, a lower quality tone can be produced with only 2 stages of synthesis to reduce the time and resources required. For analog, which employs algorithms simulating multiple oscillators and filter elements, the number of simulated "oscillators" or "filter sections" can be reduced.

Finally, to cope with the situation where none of the strategies above proves adequate, a set of waveform default tones is preloaded into cache. When no better value can be generated for the tone because of limitations on available CPU processing power, the default value is used so that at least some sound is produced in response to a tone command rather than dropping the note altogether.

Figure 18:
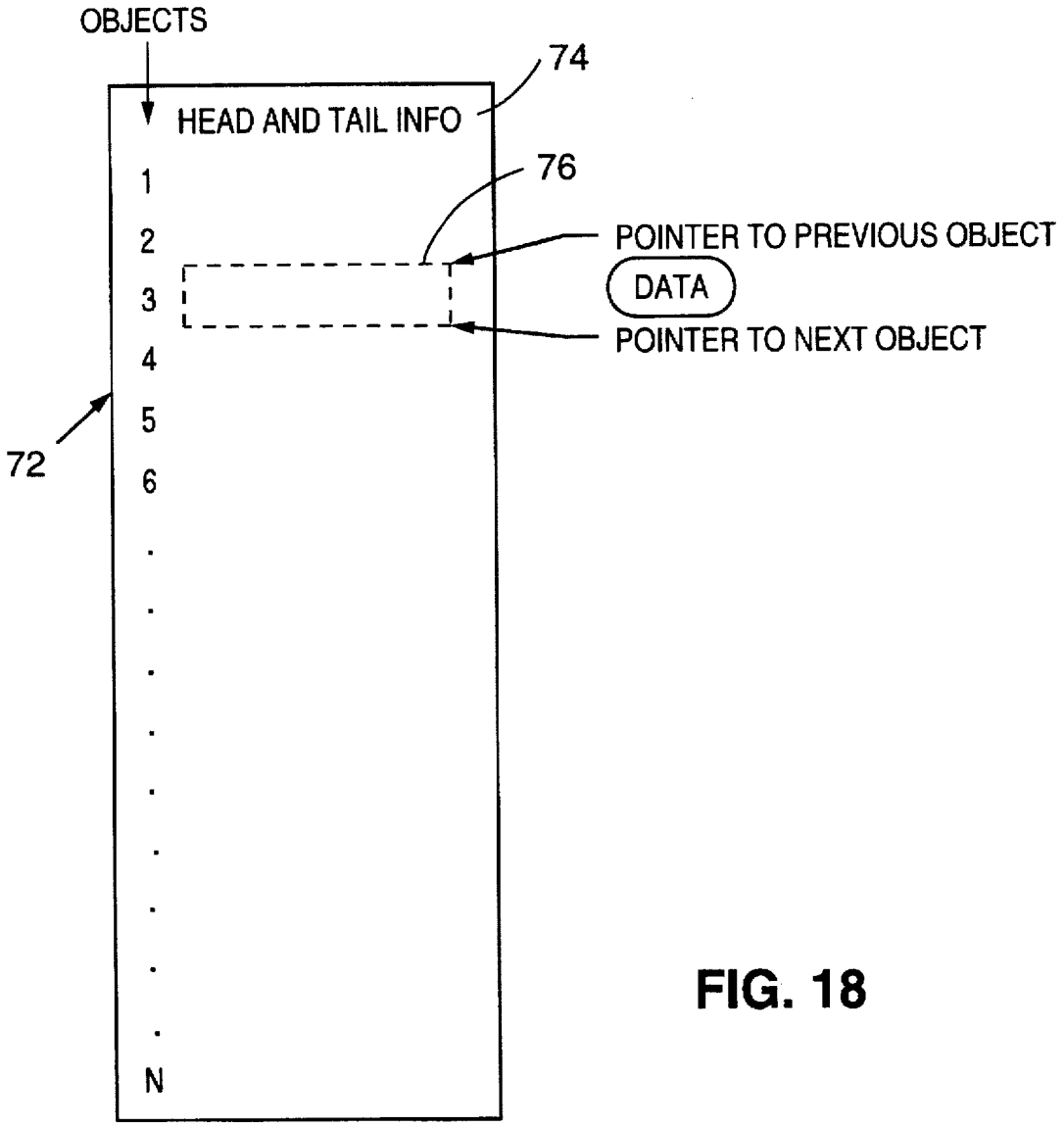
FIG. 18 is an illustration for use in explaining the organization of a linked list.

The concept of the linked list will be explained now in reference to FIG. 18. Each list element represents a note to be played. The contents of the output sound main buffer are generated by processing each list element into a corresponding Pulse Code Modulation (PCM) data and adding it to the main buffer. The addition of layers or channels is accommodated by merely adding an additional list element for the voice note. For example, a channel with a note in three voices results in three elements in the list, one for each voice. The linked list is used for more than just the active voices. There are also lists of objects for each of the caches: instruments, voices, multisamples, and samples. There are also lists for free memory buffers in a memory manager (not shown).

Each list element contains data which specifies the processing function for that element. For example, an element for a note that is to be physically modeled will contain data referring to the physical model function. By using this approach, no special processing is required for layered voices.

The CPU 16 handles the objects in the form of linked lists which are stored in a buffer memory 72. Each linked list comprises a series of N (where N is an integer) non-consecutive data entries 76 in the buffer memory 72. A first entry 74 in the buffer memory 72 represents both the address ("head") in RAM of the beginning of the first object of the linked list and the address ("tail") of being of the last object of the linked list, i.e. the last object in the linked list, not the last in terms of entries in the buffer memory.

The linked list structure gives the software enormous flexibility. The linked list can be expanded to any length that can be accommodated by the available system resources. The linked list structure also allows the priority strategies discussed above to be applied to all the notes to be played. And finally, if additional synthesis algorithms are developed, the only program modification required to accommodate the new algorithm is a pointer to a new synthesis function. The basic structure of the software does not require change.

Each entry 76, i.e. object, in the linked list stored in the buffer memory includes data, a pointer to the buffer memory address of the previous object and a pointer to the buffer memory address of the next object. When one object 76 is deleted from the buffer 72 for some reason, then the pointers of the objects 76 preceding the removed object 76 and succeeding the removed object 76 must be revised accordingly. When a new object is added to the linked list, the CPU 16 refers to the tail address to find the prior last object, updates that object's "pointer to next object" to refer to the beginning address of the newly added object, adds the former tail address as the "pointer to previous object" to the newly added object, and updates the tail address to reference this address of the newly added object.

Figure 17:
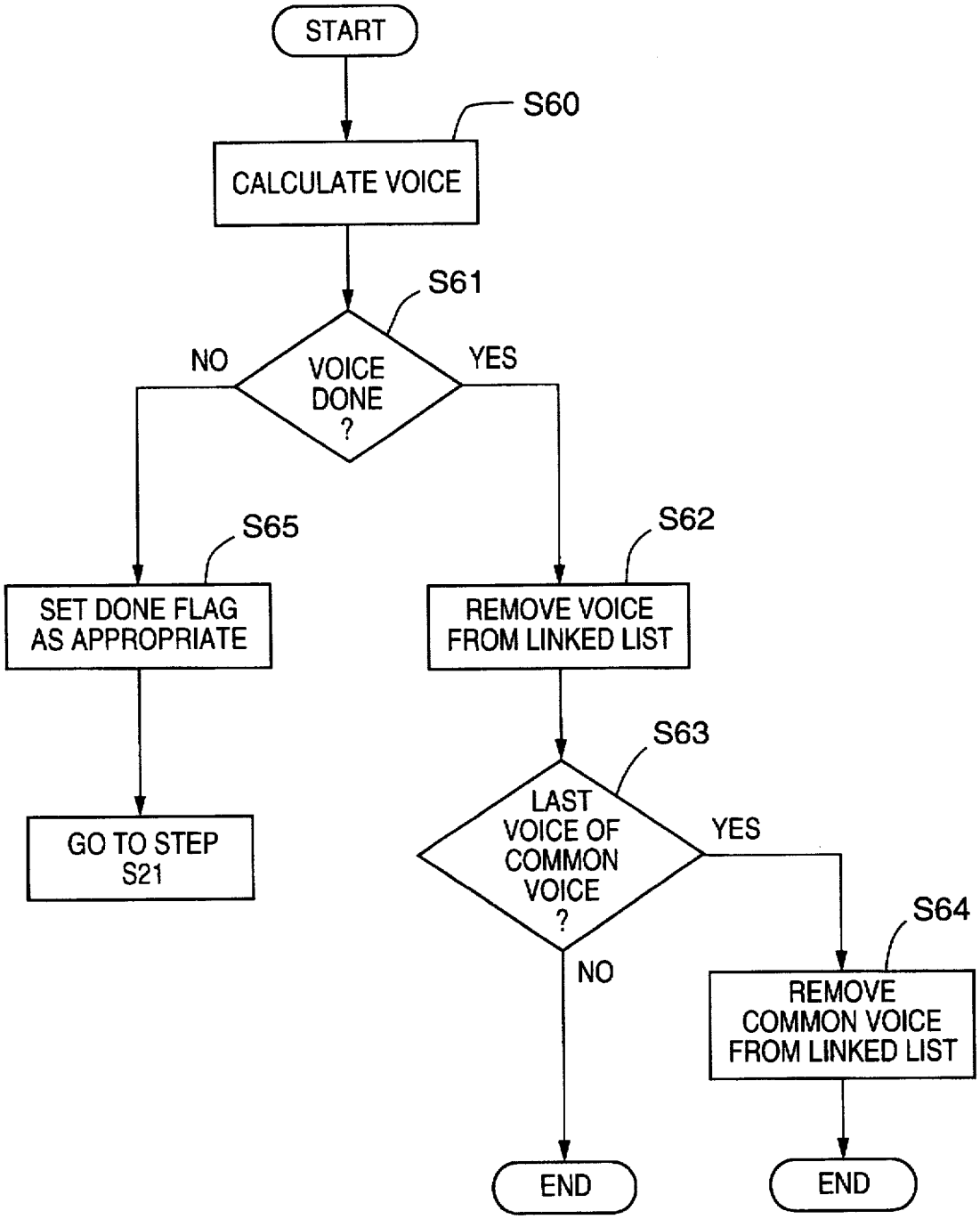
FIG. 17 is a flow chart for a CALCULATE VOICE subroutine performed by the central processor shown in FIG. 8.

Referring to FIG. 17, the CALCULATE VOICE(s) subroutine called at step S18 of the VOICE PROCESSING routine of FIG. 14 will now be explained. It will be recalled that at step S54 of the ACTIVATE VOICE subroutine, the voices are initialized, i.e. the appropriate sound synthesis algorithm 30 is selected. At step S60, the sound for each activated voice is calculated to generate voice digital data. After the voice calculation processing, if the voice is not done at step S61, the CPU 16 proceeds to step S65 to set a done flag and then to step S21 of the VOICE PROCESSING routine. However, if the voice is done, from step S61 the CPU 16 proceeds to step S62 where the voice is removed from the linked list. At the next step S63, the CPU 16 determines if the voice is the last voice of the common voice. If not, the process ends. If it is, the CPU 16 removes the common voice from the linked list at step S64 and ends the routine.

II. The Transmission Protocol & The Transmission File Format

Figure 6:
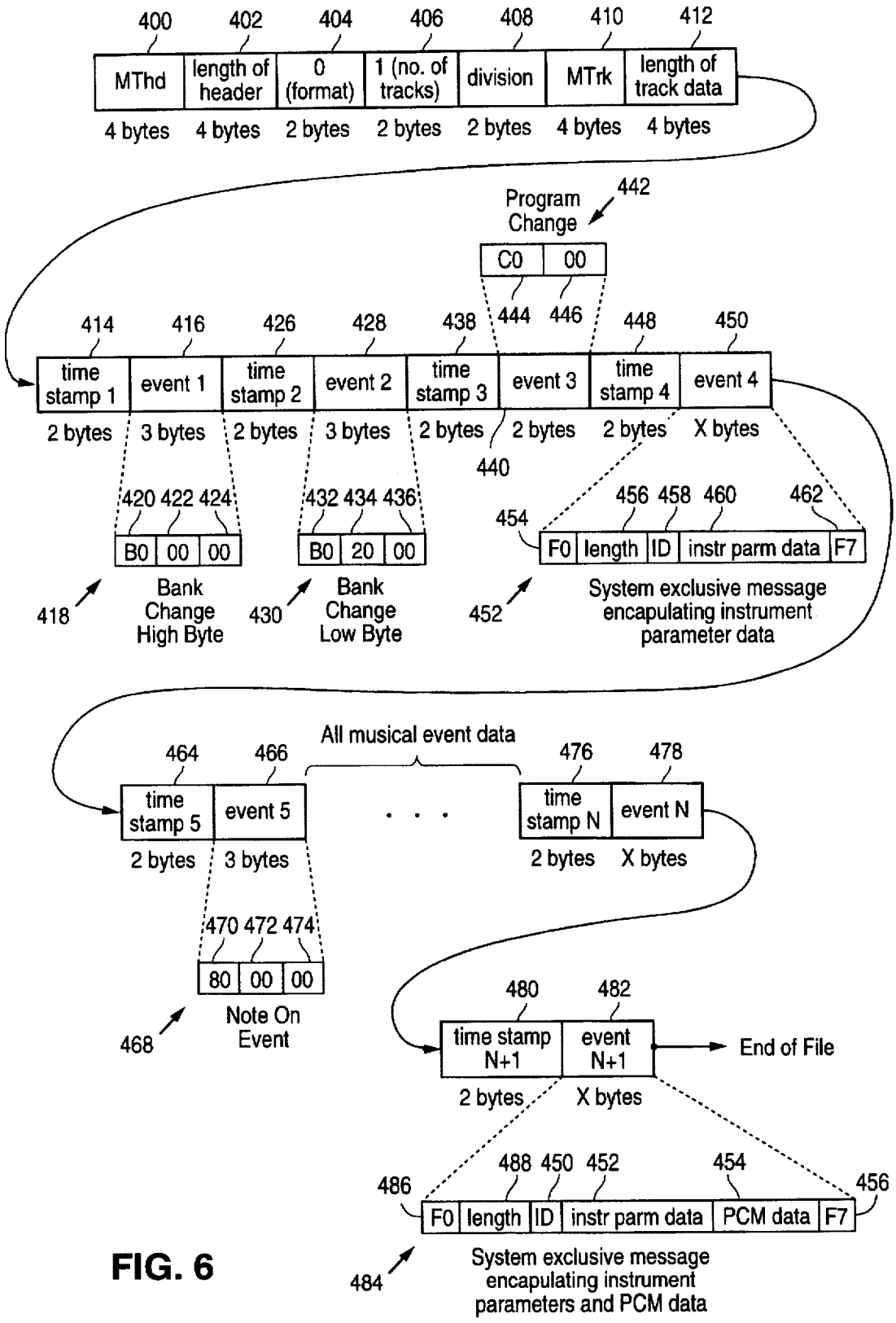
FIG. 6 is a detailed diagram depicting the file structure of a CyberMIDI music data file representative of music an used in transmission according to the present invention.

The second major component of the system is the transmission protocol. As depicted in FIGS. 5 and 6, the protocol includes a unique file format used by both the Server-Composer 118 and Client-Player 112 to send compressed music over the Internet 110 via TCP/IP. The file format provides that the MDF includes three distinct types of frames that are transmitted in a predefined order. First, voicing parameters 130 encapsulated in system exclusive messages are transmitted, next standard MIDI commands 132 are sent, and then finally, wavetable data 134 is transmitted. The transmission protocol buffers the data and treats it as streaming. This means that the beginning of a file starts playing while the balance of the data is received in the background, and algorithms and General MIDI (GM) voices are substituted for custom wavetable instruments which are downloading in the background. The buffering and streaming of the data file provide immediate playback of music from a web page, and gradual upgrading of the instrument voices as wavetable data downloads in the background.

Figure 19A:
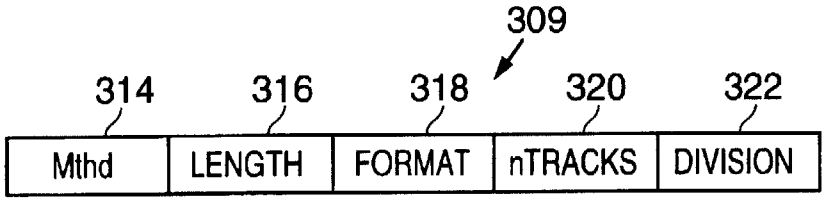
FIG. 19(a) (PRIOR ART)
FIG. 19(*a*) is a diagram of the header chunk format of a standard MIDIfile.
Figure 19B:
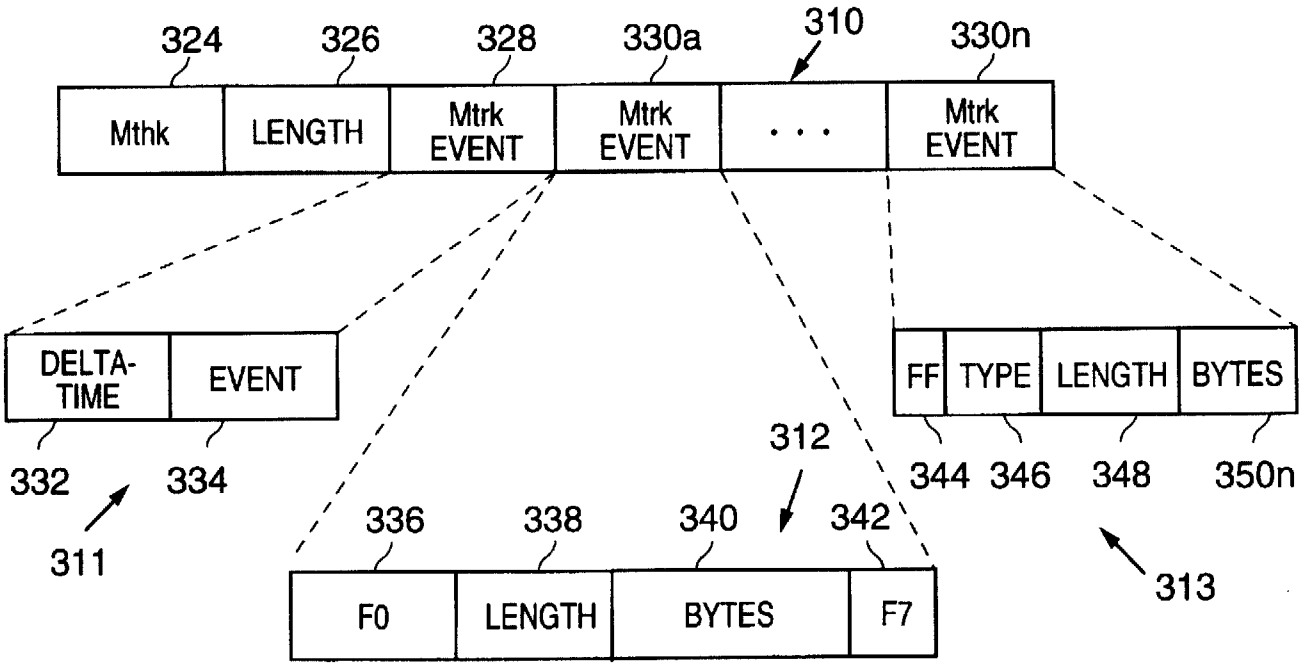
FIG. 19(b) (PRIOR ART)

FIG. 6 illustrates in detail the structure of a typical CyberMIDI MDF. As with all MIDI compliant files, the MDF starts with four bytes encoding the ASCII text "MTHD" 400 to identify the file as a MIDI type file. The next four bytes indicate the total length 402 (in bytes) of the next three fields combined which include the format field 404, the number of tracks field 406, and the division field 408. Since these three fields are each two bytes long, combined they total six bytes, and thus, the number six is encoded in the length 402 field. The next two byte field indicates the format 404 which in the preferred embodiment is always set to zero. This indicates to all MIDI playback systems that the MDF is structured as a single multi-channel track. As such, the preferred embodiment requires the number of tracks field 406 to be set to one, indicating that the entire composition will occupy only one track. By using only one track, the present invention insures that all musical events that are to happen proximate in time appear in the same place in the MDF and thus, arrive at the playback machine proximate to each other. The final field in the header chunk of the MDF is the division field 408. This field is used according to the standard MIDI specification as described above in reference to FIG. 19(*a*) division 322.

MTrk 410, which indicates the start of a music track, is the next field in the preferred embodiment as well as in standard MIDI. However, the MDF will only contain one MTrk field 410 because, as discussed above, the MDF uses only a single multi-channel track in the preferred embodiment. Similar to MThd 400, MTrk 410 is a four byte field representing the ASCII characters "MTRK". The next four bytes of the MDF indicates in bytes the total length of the track data 412.

Starting with time stamp one 414, the rest of the MDF is comprised of only two different types of chunks. The chunks formed by time stamp one 414 & event one 416; time stamp two 426 & event 428; time stamp three 438 & event three 440; and time stamp five 464 & event five 466; are all examples of standard MIDI type chunks. In other words, all of these chunks call for standard MIDI events defined in the MIDI specification.

Examples of the second type of chunk are found in the chunks formed by time stamp four 448 & event four 450 and time stamp N+1 480 & event N+1 482. These chunks include system exclusive messages which are ignored by standard MIDI systems. However, in a SSSS Client-Player machine 112 of the present invention, the system exclusive messages have special significance. It is these system exclusive messages that contain the SSSS Parameter Frames 130 and the Custom SSSS PCM Frames 134. For example, event four 450 contains special non-MIDI standard information encapsulated in a MIDI standard system exclusive message 452. System exclusive messages begin with "F0" 454 which serves as a MIDI identifier. The length 456 follows the "F0" 454. The system exclusive message ends with "F7" 462 which, together with the length 456, indicates to the system the end of the encapsulated data. This particular system exclusive message encapsulates instrument parameter data 460 which is identified by the ID field 458 that precedes it.

The chunk formed by time stamp N+1 480 & event N+1 482 is an example of wavetable data encapsulated in a system exclusive message. As with the system exclusive message 452 described above, this system exclusive message 484 starts with a MIDI identifier of "F0" 486 and a length field 488, and terminates with a "F7". The encapsulated data includes an ID field 450 that indicates that the data to follow includes PCM sound samples. Finally, instrument parameter data 452 for recreating the sampled voice precedes actual PCM data 454.

Figure 2:
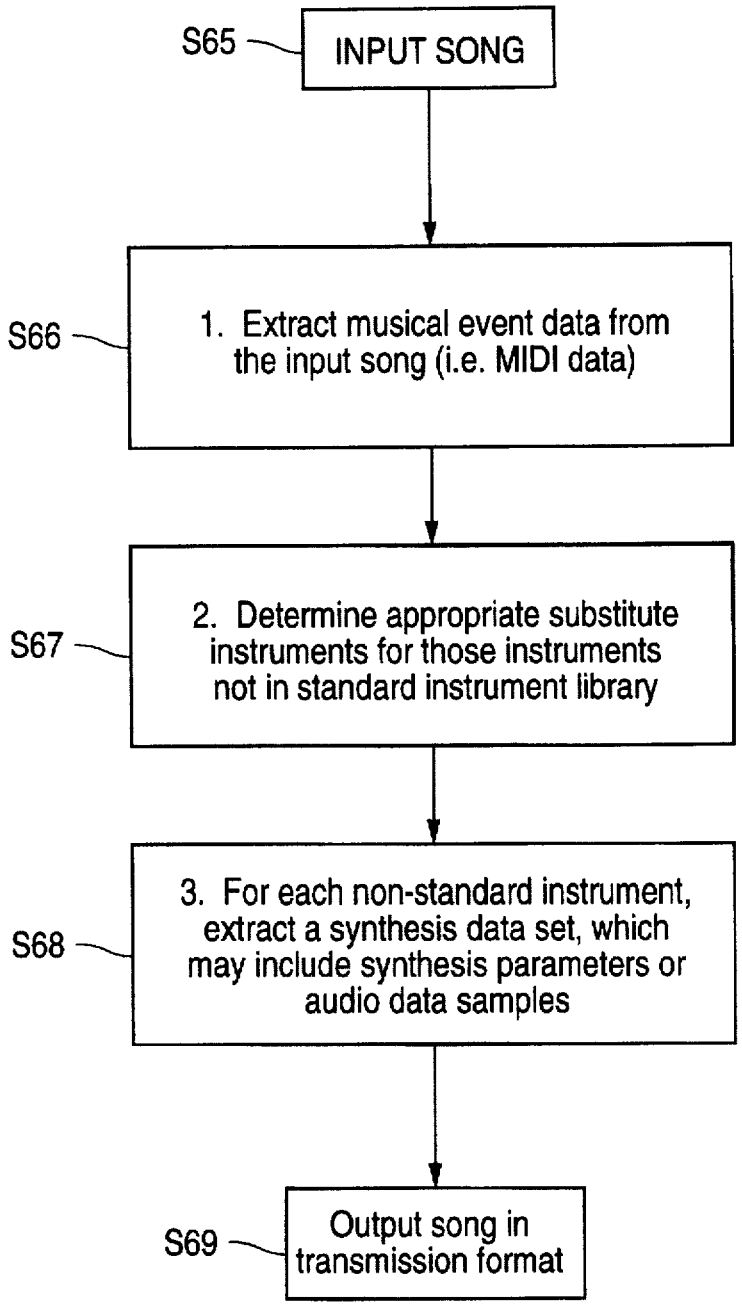
FIG. 2 is a flow chart depicting the steps required to encode music according to the present invention.

FIG. 2 illustrates the steps taken in forming the encoded, compressed MDF used in transmission. In step S65, the musical composition, including standard MIDI commands and non-MIDI standard information is loaded from the HDD 24 by the CPU 16 into RAM 26. The CPU 16 looks through the input file, extracts all data representative of standard MIDI data, and creates a new music data file containing only the standard MIDI data in step S66. In step S67 the remaining non-MIDI standard commands representing non-MIDI standard information are evaluated by the CPU to determine appropriate substitute instruments. For example, if a non-MIDI standard command calls for a custom electric guitar synthesized using the wavetable technique mentioned above, the CPU 16 will perform a database look-up to determine that a custom electric guitar can be adequately simulated using a basic electric guitar found in the GM instrument library. Once an appropriate substitute has been found for all the custom instruments not in the GM library, the standard MIDI commands for playing back the substituted instrument are added to the music data file created in step S66.

For example, after step S67, the data file might contain MIDI commands to play music using six different voices on six different channels. From step S66 the file would specify, for example, that channels zero through two are comprised of music played in three different voices from the GM library. Meanwhile, after step S67, the file would also specify that channels three through five will each play music in voices chosen from the GM library to most nearly match the custom voices specified in the original composition. Additionally, the music data file would also contain control information that would indicate to the Playback Module 236 that the voices used to play music on channels three through five will be replaced by voices whose information is to follow.

The control information takes the form of a special sequence of two back-to-back voice assignment commands to the same channel. The first voice assignment command assigns the channel to the bank and program of the GM voice selected to substitute for the custom voice. The second voice assignment command, which immediately follows the first, re-assigns the same channel to a bank and program that will eventually contain a custom wavetable voice.

Once all the MIDI commands, the substitute MIDI commands, and the control information indicating which MIDI commands will have their voices replaced has been added to the MDF, the CPU 16 moves to step S68. In this step, the CPU 16 examines the non-standard instruments and for each one extracts a synthesis data set. The synthesis data set can include synthesis voicing parameters and audio PCM data samples. The synthesis data set contains all the information the Client-Player PC 112 will need to recreate the voice upon receipt. The voicing parameters 130 are encapsulated in system exclusive messages and appended to the beginning of the data file created in steps S66 and S67. Finally, if there are any audio PCM data samples, they are encapsulated in system exclusive messages and appended to the end of MDF as a third field 134. The end result of the flow chart depicted in FIG. 2 is the MDF format depicted in FIGS. 5 and 6. As mentioned above the Transmission Module 222 provides the capability to transmit the MDF via TCP/IP in the following pre-defined order: (1) SSSS voicing parameters 130, (2) standard MIDI data and control information 132, (3) wavetable data 134.

Figure 3:
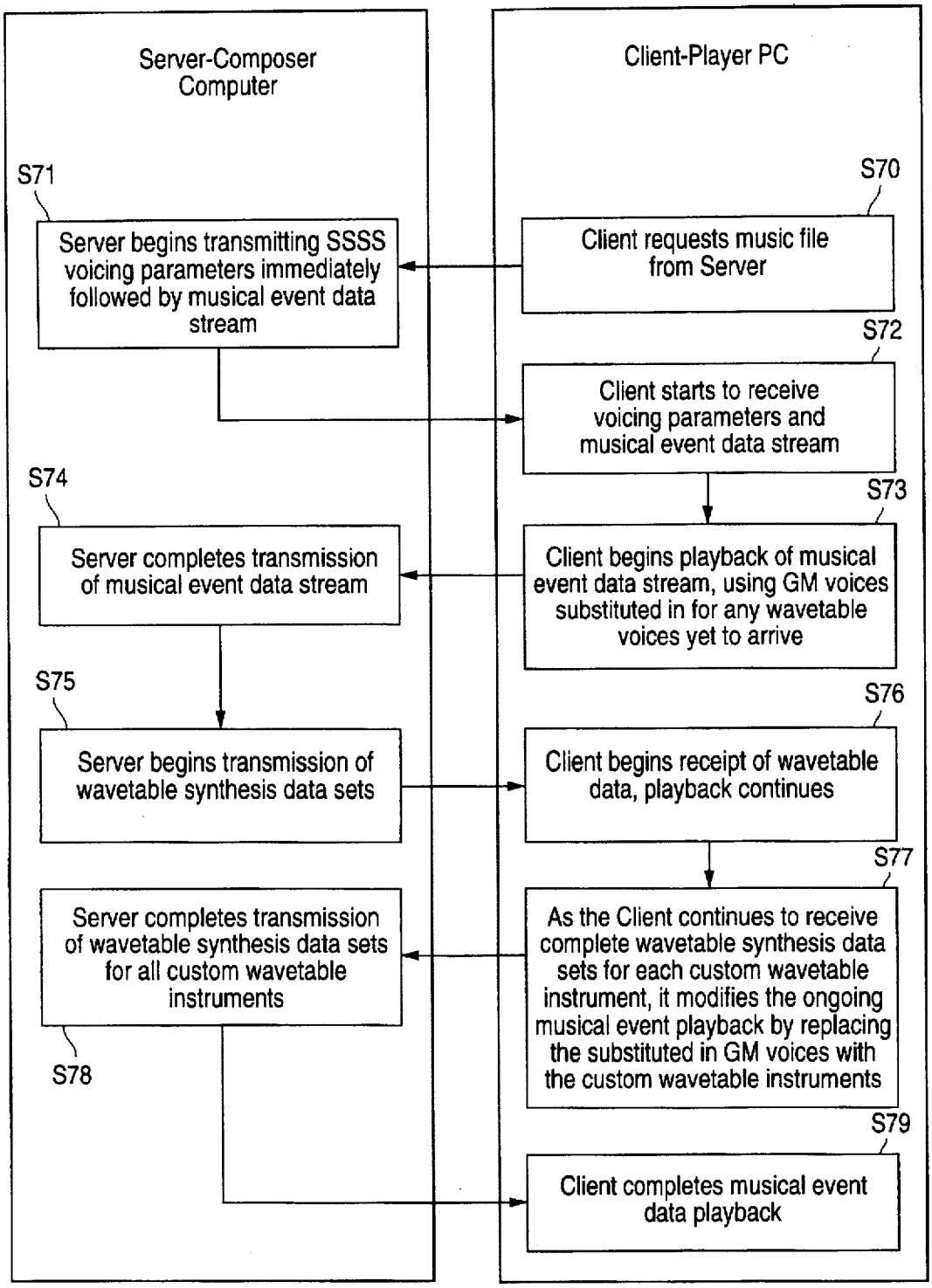
FIG. 3 is a flow chart depicting the steps required to transmit and playback music according to the present invention.
Figure 7:
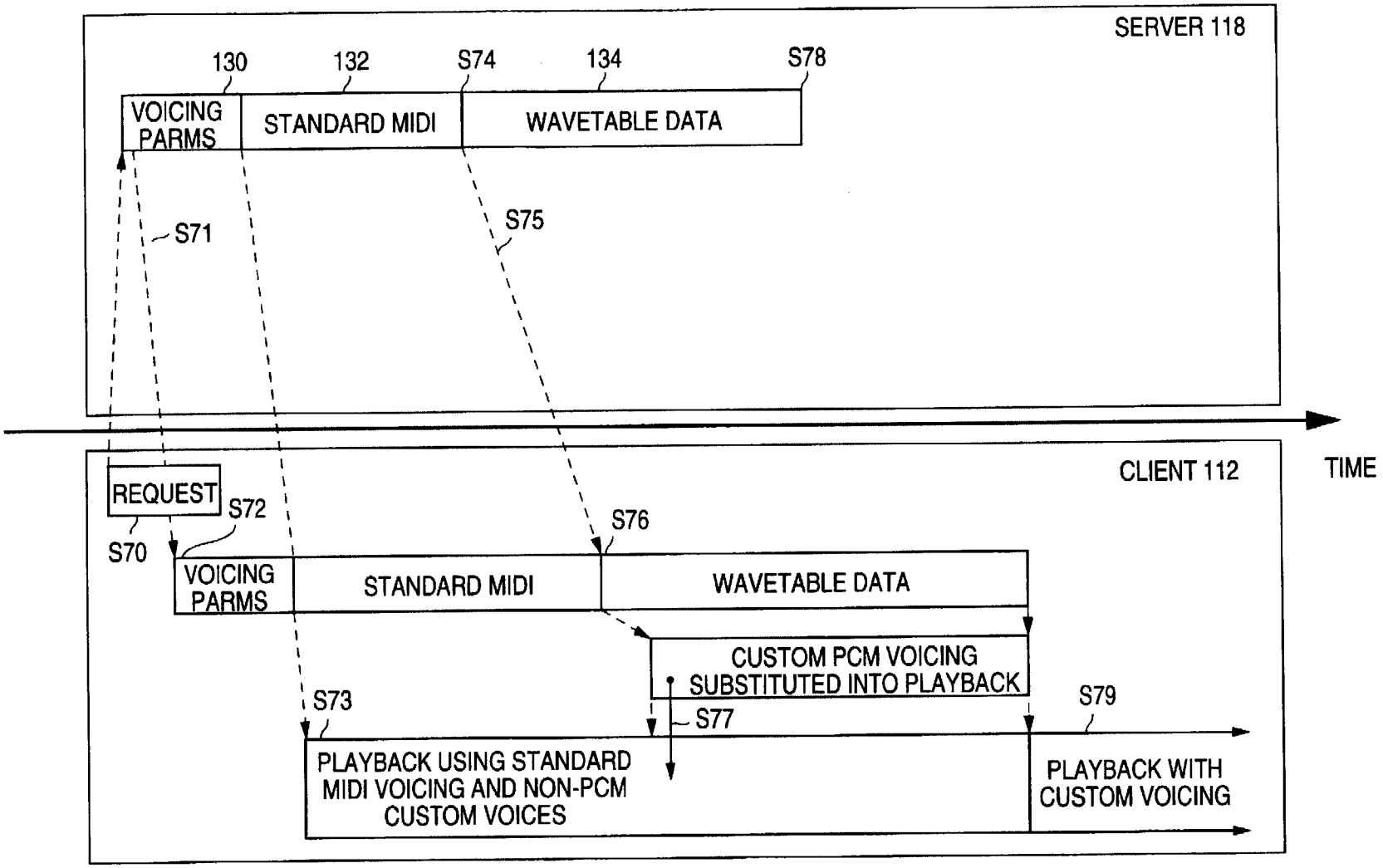
FIG. 7 is a timing diagram depicting the relative timing of the transmission and playback method shown in FIG. 3.

Referring to FIGS. 3 and 7, the MDF is transferred and processed as follows. The Client-Player 112 first requests music from the Server-Composer PC 118 in step S70. This request is in the form of the Client-Player 112 connecting to the Server-Composer's 118 Internet 110 IP address and then activating the download of a music data file by clicking on an CyberSound™ MDF icon found on the server's 118 web page. The server 118 responds in step S71 by beginning to transmit a stream of SSSS voicing parameters encapsulated in system exclusive messages and standard MIDI musical event data. This musical event data is comprised of the second field 132 of the MDF discussed above. The second field 132 includes MIDI event data, substituted-in GM voicing data, and control information.

The MIDI data is in MIDI Standard 1.0 Format and is sub-divided and ordered such that upon step S72, where the Client-Player 112 begins to receive the musical event data stream, the first segments of MIDI data initiate immediate Client-Player 112 playback in step S73. Meanwhile, the remainder of the MIDI data and encapsulated SSSS voicing parameters continue to be transmitted and received. Data is received substantially faster than it is audibly reproduced, thereby requiring buffering of the received MDF, and allowing instantaneous playback upon receipt while the voicing parameters 130 are processed to create all but the wavetable custom voices.

The voicing parameters might include data necessary to perform physical modeling, FM emulation, and analog synthesis. For example, in the preferred embodiment, these different algorithms would include the following parameters: for Analog synthesis the parameters include: Name, Priority, Pitch, Trigger, Transpose, Fine Tune, Insert Effects, Volume, Pan, Global Effects Type 1, Global Effects Type 2, Global Effects Send 1, Global Effects Send 2, Oscillator 1 Waveform, Oscillator 1 Pulse Width, Oscillator 1 Frequency, Oscillator 1 Amplitude, Oscillator 2 Waveform, Oscillator 2 Pulse Width, Oscillator 2 Frequency, Oscillator 2 Amplitude, Oscillator 2 Waveform, Oscillator 3 Pulse Width, Oscillator 3 Frequency, Oscillator 3 Amplitude, Portamento, Filter Type, Filter Cutoff, and Filter Resonance; for FM synthesis the parameters include: Name, Priority, Pitch, Trigger, Transpose, Fine Tune, Insert Effects, Volume, Pan, Global Effects Type 1, Global Effects Type 2, Global Effects Send 1, and Global Effects Send 2; and for Physical Modeling synthesis the parameters include: Name, Priority, Pitch, Trigger, Transpose, Fine Tune, Insert Effects, Volume, Pan, Global Effects Type 1, Global Effects Type 2, Global Effects Send 1, Global Effects Send 2, Algorithm type, Speed, Amplitude, Frequency, Lowpass filter, Allpass filter, Allpass filter order, Feedback, Frequency. The voicing parameters also include parameters for the SSSS effects processors.

For any non-standard, wavetable instruments, the initial segments received include a special back-to-back sequence of standard MIDI bank change 418, 430 and program change voicing assignment commands that will indicate to the Client-player PC 112 that a GM voice is being substituted-in for a custom wavetable voice whose synthesis data will follow later in the MDF. The control information that triggers the GM voices in the Client-Player 112 as substitutes for instruments, defined by voicing parameters and wavetable data that will be transmitted later in the sequence, include standard MIDI bank change 418, 430 and program change 442 voicing assignment commands as depicted in FIG. 6. An initial set of bank and program change commands that will assign a channel to an appropriate GM voice will immediately be followed by a second set of bank and program change commands that will attempt to set the channel to an undefined voice. A standard MIDI playback system would simply ignore the commands calling for an undefined voice, while the Client-Player 112 of the present invention will interpret this special back-to-back sequence as denoting a voice that will need to be replaced when the custom wavetable voice specified in the second set of bank and program change commands becomes available.

In step S74 the server 118 completes transmission of the first two fields 130 and 132 of the MDF. Transmission of the non-standard wavetable instrument synthesis data set begins immediately in step S75. The wavetable synthesis data set includes any voicing or setup parameters for wavetable synthesis instruments unique to the SSSS. This data set is encapsulated in a standard MIDI system exclusive message as depicted in the frame 484 of FIG. 6. During step S75, the custom wavetable data 134, used in creating the music on the SSSS Composer 118, is transmitted to the Client-Player 112 in the background in stages. In other words, the wavetable data is passed to the Client-Player 112 as discrete instrument data fields while the Client-Player 112 continues to play the music that has already arrived.

In the preferred embodiment, the voicing parameters used to synthesize wavetable voices include: Name, Priority, Pitch, Trigger, Transpose, Fine Tune, Insert Effects, Volume, Pan, Global Effects Type 1, Global Effects Type 2, Global Effects Send 1, Global Effects Send 2, Oversample, Filter Type, Filter Cutoff, Filter Resonance, Interpolation Type, Original Note, Sample Width, Sample Type, Sample Rate, Sample Length, Loop Start, LoopEnd. The wavetable synthesis data set also includes settings for the SSSS effects processors.

In step S76, the Client-Player 112 begins receiving the non-standard instrument wavetable synthesis data sets while the music continues to play in the foreground. In step S77, as information for recreating each instrument is received, it is used to replace the GM voices that were used as a "place holder" substitutes. While playback continues in the foreground, step S77 repeats this instrument upgrading process in the background for each instrument until all wavetable data 134 has been transmitted at step S78 and downloaded to the Client-Player 112. In step S79, the Client-Player 112 continues playback with the instrument voices as originally composed until the entire MDF has been played.

It is important to realize that most of the audio playback happens with the voices of the original composition. This is because the time it takes to download the wavetable synthesis data set is substantially shorter than the time required to playback the audio signals of the original composition.

III. The Playback Software & The Client-Player PC

Referring once again to FIG. 1, the third major component of the system is the Client-Player 112 running the SSSS. The Client-Player 112 includes a driver-level playback engine which responds to the encoded data. The Client-Player 112 is configured as an "Internet ready" application, fully integrated into a variety of Internet browser environment formats, including Netscape Navigator 230 Plug-In 232 from Netscape Corporation, Microsoft Explorer 246 ActiveX Controls 243 from Microsoft Corporation, and Java 238 applet 240 from Sun Microsystems Corporation.

The SSSS Client-Player UI 234, 242, 250 is minimal. It runs at driver level as a Netscape Navigator Plug-In 232, Microsoft Explorer Active-X Control 248, or Java applet 240 and operates mostly in the background with playback-only capability. A single click on the CyberSound icon in the client web page initiates the playback of the music data file. An option-click on the CyberSound icon brings up a simple display window to control volume and set other basic parameters.

The Playback Module 236, 244, 252 is driver level code which responds to the MDF. It is implemented as a Netscape Navigator Plug-In 232, a Microsoft Explorer ActiveX Control 248, and a Java applet 240. As discussed above it has a minimal user interface, but does include effects processing and the additional SSSS synthesis types, i.e., analog synthesis, FM synthesis, and physical modeling. It also includes a 32-bit sequence player to trigger the synthesis playback engine.

The Playback Module 236, 244, 252 plays the music event stream in the foreground while the MDF downloads in the background. The Playback Module 236, 244, 252 watches for special back-to-back sequences of bank and program change commands which denote voices that will need to be replaced once the custom wavetable data has been downloaded. As playback progresses, the Playback Module 236, 244, 252 also watches for note-on commands that call for the substituted-in voice. Each time the substituted-in voice is called for, the module 236, 244, 252 will check the download buffers in RAM 26 to see if the custom wavetable voice is available yet. As soon as the custom wavetable voice has become available and it is called for, the Client-Player 112 reassigns the channel to the newly available voice. Once all of the channels playing substituted-in voices have been reassigned to custom wavetable voices the music being played back will sound identical to the original composition.

Although the present invention has been shown and described with respect to preferred embodiments, various changes and modifications which are obvious to a person skilled in the art to which the invention pertains are deemed to lie within the spirit and scope of the invention as claimed.

What is claimed is:

1. A method for streaming transmission of signals representative of music for real time playback over a network comprising the steps of:

(a) encoding the music using MIDI representations, voicing parameters, and custom wavetable data;

(b) transmitting a data file via the Internet containing the encoded music;

(c) receiving the encoded music data file;

(d) playing back the encoded music data file in the foreground on one or more devices connected to the network as it arrives, initially using only standard MIDI musical instruments substituted for any non-MIDI standard musical instruments, as specified in the original composition, while data containing voicing parameters and custom wave table information necessary to play the original non-MIDI standard musical instruments is received in the background; and (e) replacing the substituted standard MIDI musical instruments with the original non-MIDI standard musical instruments as the play back continues in the foreground and the data containing voicing parameters and custom wave table information is received in the background.

2. The method of claim 1 wherein the encoding of the music comprises the steps of:

(a) storing in a first file MIDI code of the music that can be accurately represented using MIDI standard music data;

(b) determining MIDI standard instruments that provide the best approximation for the music that is not played by MIDI standard instruments;

(c) storing in a second file MIDI code of the music that best approximates the music originally played by non-MIDI standard instruments; and (d) creating a third data file by incorporating the stored first and second files comprising a plurality of fields including:

a first field having a complete representation of the music using only MIDI standard instruments; and a second field having data containing voicing parameters and custom wave table information for recreating the original music created using non-MIDI standard instruments.

3. The method of claim 1 wherein encoding the music comprises the steps of:

(a) storing in a first file data representative of instrument voices;

(b) storing in a second file MIDI code of the music that can be accurately represented using MIDI standard instruments;

(c) determining MIDI standard instruments that provide the best approximation for the music that is not played by MIDI standard instruments;

(c) storing in a third file MIDI code of the music that best approximates the music originally played by non-MIDI standard instruments; and (d) creating a fourth data file by incorporating the stored first, second files and third files comprising a plurality of fields including:

a first field having data representative of instrument voices;

a second field having a complete representation of the music using only MIDI standard instruments and instrument voices defined by the data of the first field; and a third field having data containing voicing parameters and custom wave table information for recreating the original music created using non-MIDI standard instruments.

4. The method of claim 1 wherein the voicing parameters include data to synthesize music altered by one or more special effects including reverberation, spatialization, equalization, and chorusing processing.

5. A network music transfer and compression system comprising:

a plurality of remotely situated computing means for storing and playing a data file having a plurality of fields representative of music and musical voices;

network means for interconnecting the plurality of computing means to facilitate data transfer between them;

communications protocol means for compressing the data file and transferring it from one of the plurality of computing means operating as a server means to one or more of the remaining computing means operating as one or more recipient means comprising:

means for sequentially transmitting the plurality of fields of the data file over the network means from the server means;

means for receiving and processing a first field containing data representative of MIDI standard music and musical voices at the one or more recipient means in a background processing operation;

play back means for playing the received data, using MIDI standard instruments, by the recipient means in a foreground processing operation;

means for receiving at the recipient means, upon completed receipt of the first field in the background operation, a second field transmitted by the server means and containing non-MIDI standard instrument information; and means at the recipient means for replacing select MIDI standard instruments used by the playback means with non-MIDI standard instruments as the non-MIDI standard instrument information becomes available in the background operation.

6. A method of encoding and compressing music without losing any information comprising the steps of:

(a) storing in a first file data representative of instrument voices;

(b) storing in a second file MIDI code of the music that can be accurately represented using MIDI standard instruments;

(c) determining MIDI standard instruments that provide the best approximation for the music that is not played by MIDI standard instruments;

(d) storing in a third file MIDI code of the music that best approximates the music originally played by non-MIDI standard instruments; and (e) creating a fourth data file by incorporating the stored first, second files and third files comprising a plurality of fields including:

a first field having data representative of instrument voices;

a second field having a complete representation of the music using only MIDI standard instruments and instrument voices defined by the data of the first field; and a third field having data containing voicing parameters and custom wave table information for recreating the original music created using non-MIDI standard instruments.

7. A data file format for representing music in a compressed format comprising:

a first field having data representative of instrument voices;

a second field having a complete representation of the music using only MIDI standard instruments and instrument voices defined by the data of the first field; and a third field having data containing voicing parameters and custom wave table information for recreating the original music created using non-MIDI standard instruments.

* * * * *